US011130332B2

(12) United States Patent
Shinkawa et al.

(10) Patent No.: US 11,130,332 B2
(45) Date of Patent: Sep. 28, 2021

(54) HEAD UNIT AND LIQUID DISCHARGING APPARATUS

(71) Applicant: SEIKO EPSON CORPORATION, Tokyo (JP)

(72) Inventors: Osamu Shinkawa, Nagano (JP); Masashi Kamiyanagi, Nagano (JP); Toshiyuki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 16/800,061

(22) Filed: Feb. 25, 2020

(65) Prior Publication Data

US 2020/0269570 A1 Aug. 27, 2020

(30) Foreign Application Priority Data

Feb. 27, 2019 (JP) ..... JP2019-033846

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04595; B41J 2/04541
See application file for complete search history.

(56) References Cited

U.S. PATENT DOCUMENTS

2015/0062219 A1 3/2015 Okita
2019/0009527 A1* 1/2019 Yamada ..... B41J 2/04581

FOREIGN PATENT DOCUMENTS

JP 2017-105219 A 6/2017

* cited by examiner

*Primary Examiner* — Lam S Nguyen
(74) *Attorney, Agent, or Firm* — Global IP Counselors, LLP

(57) ABSTRACT

A head unit comprising: a first line through which a driving signal is supplied; a first discharging section that has a first piezoelectric element having a first electrode, the first discharging section discharging liquid according to the displacement of the first piezoelectric element, the displacement being caused when the driving signal is supplied to the first electrode; a detection circuit that detects the potential of a second line; a first switch that makes a switchover as to whether to electrically couple the first electrode and first line together; a second switch that makes a switchover as to whether to electrically couple the first electrode and second line together; a third switch that makes a switchover as to whether to electrically couple the first line and second line together; and a first resistor provided in series with the third switch between the first line and the second line.

5 Claims, 16 Drawing Sheets

| Sd[m] | TYPE OF SPECIFIED D[m] | Qc[m] | | Qs[m] | |
|---|---|---|---|---|---|
| | | TP1 | TP2 | TP1 | TP2 |
| 1 | DP1 (LARGE DOT) | H | H | L | L |
| 2 | DP2 (MEDIUM DOT) | H | L | L | L |
| 3 | DP3 (SMALL DOT) | L | H | L | L |
| 4 | DP0 (NOT FORMED) | L | L | L | L |

| Sd[m] | TYPE OF SPECIFIED D[m] | Qc[m] | Qs[m] |
|---|---|---|---|
| 1 | DB1 (MICRO-VIBRATION) | H | L |
| 2 | DP0 (STATIONARY) | L | L |

FIG. 11

| Sd[m] | TYPE OF SPECIFIED D[m] | Qc[m] | | Qs[m] | |
|---|---|---|---|---|---|
| | | TM1 | TM2 | TM1 | TM2 |
| 1 | DK (ELIGIBLE FOR INSPECTION) | H | L | L | L |
| 2 | DK0 (NOT ELIGIBLE FOR INSPECTION) | H | H | L | L |

FIG. 12

| Sd[m] | TYPE OF SPECIFIED D[m] | Qc[m] | | Qs[m] | |
|---|---|---|---|---|---|
| | | TK1 | TK2 | TK1 | TK2 |
| 1 | DK1 (PLANNED-TO-BE-INSPECTED) | L | L | L | L |
| 2 | DK2 (INSPECTION-IN-PROGRESS) | L | H | H | L |
| 3 | DK3 (INSPECTED) | H | H | L | L |
| 4 | DK4 (NOT ELIGIBLE FOR INSPECTION) | H | H | L | L |

| NTc | NVT |
|---|---|
| NTc < Tth1 | 2: DISCHARGING FAILURE (BUBBLES) |
| Tth1 ≤ NTc ≤ Tth2 | 1: NORMAL |
| Tth2 < NTc | 3: DISCHARGING FAILURE (ADHESION OF FOREIGN MATTER OR INCREASED VISCOSITY) |

FIG. 20

| Sd[m] | TYPE OF SPECIFIED D[m] | Qc[m] | | | Qs[m] | | |
|---|---|---|---|---|---|---|---|
| | | TSS1 | TSS2 | TSS3 | TSS1 | TSS2 | TSS3 |
| 1 | DK (ELIGIBLE FOR INSPECTION) | H | L | H | L | H | L |
| 2 | DKO (NOT ELIGIBLE FOR INSPECTION) | L | L | L | L | L | L |

HEAD UNIT AND LIQUID DISCHARGING APPARATUS

The present application is based on, and claims priority from JP Application Serial Number 2019-033846, filed Feb. 27, 2019, the disclosure of which is hereby incorporated by reference herein in its entirety.

BACKGROUND

1. Technical Field

The present disclosure relates to a head unit and a liquid discharging apparatus.

2. Related Art

A liquid discharging apparatus such as an ink jet printer executes print processing in which a piezoelectric element included in a discharging section provided in a head unit is driven with a driving signal and is displaced so that a liquid, such as an ink, supplied in the discharging section is discharged to form an image on a medium such recording paper. This type of liquid discharging apparatus may cause a discharging failure in which the liquid cannot be normally discharged from the discharging section when, for example, the liquid in the discharging section becomes viscous or foreign matter adheres to the discharging section. When a discharging failure is caused, the liquid discharged from the discharging section cannot accurately form a predicated dot on a medium. As a result, in print processing, the quality of the image formed on the medium is lowered. In a technology proposed in prior art in view of this, while a driving signal is being supplied to a piezoelectric element, the potential of the driving signal is changed to cause the discharging section to vibrate. According to a detection result for vibration caused in the discharging section, the discharging state of the liquid in the discharging section is inspected to prevent a drop in image quality, which would otherwise be caused by a discharging failure (see JP-A-2017-105219, for example).

In the technology proposed in prior art, however, the potential of the driving signal is changed to vibrate the discharging section while the supply of the driving signal to the piezoelectric element is maintained. Therefore, there was a case in which it takes time from when the supply of the driving signal to the piezoelectric element starts until the discharging section starts to vibrate. This may cause the problem that much time is taken to inspect the discharging state, particularly in a situation in which more discharging sections are being provided in a recent liquid discharging apparatus.

SUMMARY

To solve the above problem, a head unit according to the present disclosure has: a first line through which a driving signal is supplied; a first discharging section that has a first piezoelectric element having a pair of electrodes including a first electrode, the first discharging section discharging a liquid according to the displacement of the first piezoelectric element, the displacement being caused when the driving signal is supplied to the first electrode; a detection circuit that detects the potential of a second line; a first switch that makes a switchover as to whether to electrically couple the first electrode and first line together; a second switch that makes a switchover as to whether to electrically couple the first electrode and second line together; a third switch that makes a switchover as to whether to electrically couple the first line and second line together; and a first resistor provided in series with the third switch between the first line and the second line.

BRIEF DESCRIPTION OF THE DRAWINGS

FIG. 11 indicates an example of the individual specification signal.

FIG. 12 indicates an example of the individual specification signal.

FIG. 20 indicates an example of an individual specification signal in the reference example.

DESCRIPTION OF EXEMPLARY EMBODIMENTS

Figure 1:
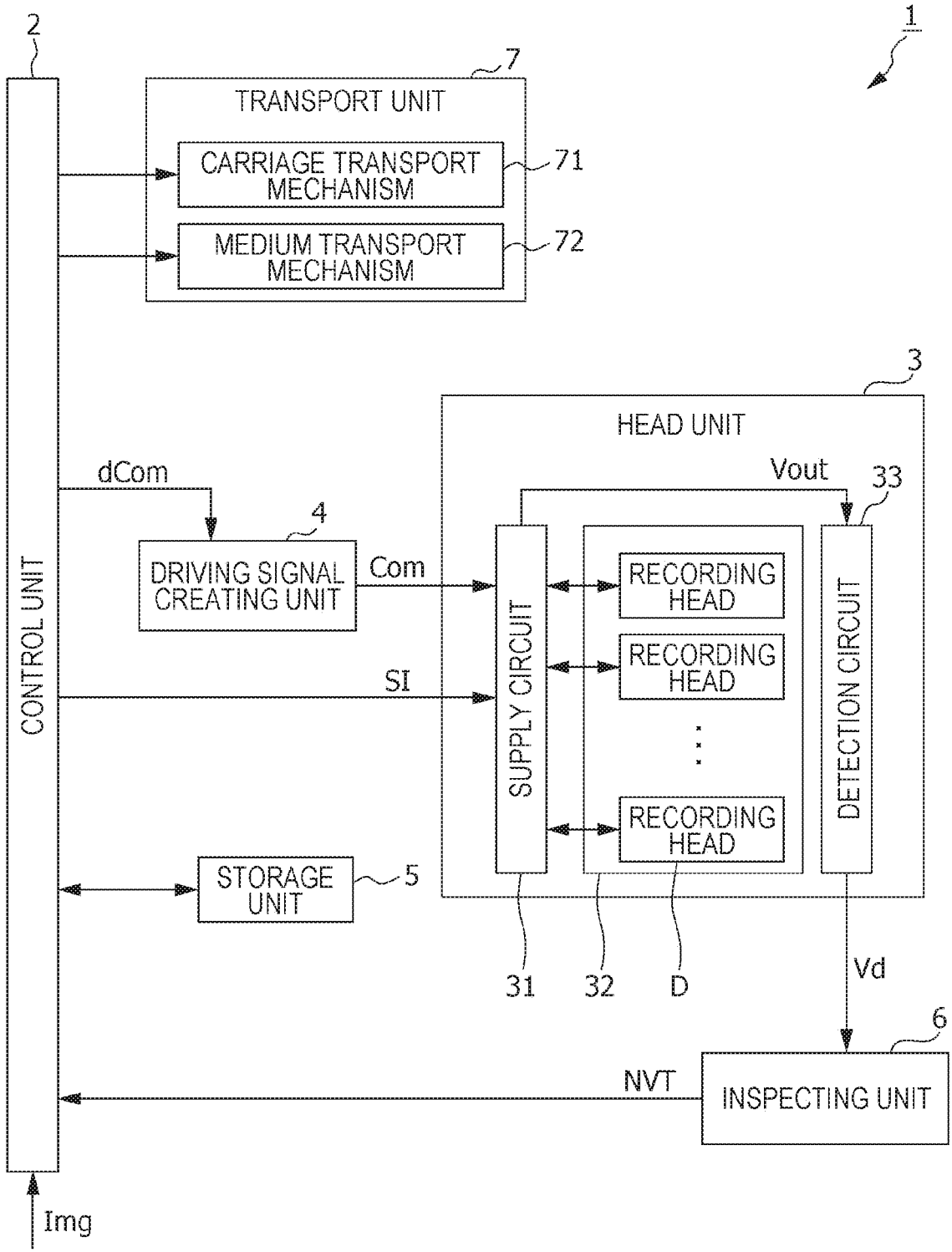
FIG. 1 is a block diagram illustrating an example of the structure of an ink jet printer according an embodiment of the present disclosure.

An embodiment of the present disclosure will be described below with reference to the drawings. The dimensions and scales of individual sections and portions in the drawings differ from their actual dimensions and scales, as appropriate. Since the embodiment described below is a preferred specific example in the present disclosure, various limitations that are desirable from a technical viewpoint have been added. However, the scope of the present disclosure is not limited to these forms unless, in the explanation below, there is a particular description that limits the present disclosure.

A. EMBODIMENT

In this embodiment, to explain a liquid discharging apparatus, an ink jet printer that discharges ink to form an image on recording paper P will be exemplified. In this embodiment, the ink is an example of a liquid, and the recording paper P is an example of a medium.

1. OUTLINE OF THE INK JET PRINTER

The structure of the ink jet printer 1 according to this embodiment will be described below with reference to FIGS. 1 and 2.

FIG. 1 is a functional block diagram illustrating an example of the structure of the ink jet printer 1. The ink jet printer 1 receives print data Img, which indicates an image to be formed by the ink jet printer 1, from a host computer such as a personal computer or digital camera. The ink jet printer 1 then executes print processing to form, on recording paper P, the image indicated by the print data Img that has been received from the host computer.

As illustrated in FIG. 1, the ink jet printer 1 has a control unit 2 that controls individual sections in the ink jet printer 1, a head unit 3 in which discharging sections D that discharge ink is provided, a driving signal creating unit 4 that creates a driving signal Com used to drive the relevant discharging section D, a storage unit 5 that stores various types of information, an inspecting unit 6 that inspects the discharging state of the ink in each discharging section D, and a transport unit 7 that changes the relative position of the recording paper P with respect to the head unit 3.

In this embodiment, it will be assumed that the ink jet printer 1 has one or a plurality of head units 3, one or a plurality of inspection units 6, which are in one-to-one correspondence with the one or plurality of head units 3, and one or a plurality of driving signal creating units 4, which are in one-to-one correspondence with the one or plurality of head units 3. For convenience, however, the description below will focus on one of the one or plurality of head units 3, one inspecting unit 6 disposed in correspondence with the one head unit 3, and one driving signal creating unit 4 disposed in correspondence with the one head unit 3, as illustrated in FIG. 1.

The control unit 2 includes a central processing unit (CPU). However, the control unit 2 may include a programmable logic device such as a field-programmable gate array (FPGA) instead of the CPU or besides the CPU. The control unit 2 creates a print signal SI, a waveform specification signal dCom, and other signals that control individual sections in the ink jet printer 1 when the CPU operates according to a control program stored in the storage unit 5.

The waveform specification signal dCom is a digital signal that stipulates the waveform of the driving signal Com. The driving signal Com is an analog signal that drives the relevant discharging section D. The driving signal creating unit 4, which includes a digital-to-analog (DA) conversion circuit, creates a driving signal Com having a waveform stipulated by the waveform specification signal dCom. The print signal SI is a digital signal that specifies a type of operation of the relevant discharging section D. Specifically, the print signal SI specifies whether to supply a driving signal Com to the relevant discharging sections D to specify a type of operation of the discharging section D.

As illustrated in FIG. 1, the head unit 3 has a supply circuit 31, a recording head 32, and a detection circuit 33.

The recording head 32 has M discharging sections D. The value M is a natural number equal to or greater than 2. In the description below, of the M discharging sections D provided in the recording head 32, an m-th discharging section D will sometimes be referred to as a discharging section D[m]. The variable m is a natural number in the range from 1 to M. When a signal, a constituent element in the ink jet printer 1, or the like corresponds to the discharging section D[m] of the M discharging sections D, the reference characters of the constituent element, the signal, or the like will sometimes be suffixed with [m].

The supply circuit 31 makes a switchover as to whether to supply a driving signal Com to the discharging section D[m], in response to the print signal SI. In the description below, the driving signal Com that is to be supplied to the discharging section D[m] will sometimes be referred to as the supply driving signal Vin[m]. The supply circuit 31 also makes a switchover as to whether to supply a detected potential signal Vout[m], which indicates the potential of an upper electrode Zu[m] of a piezoelectric element PZ[m] included in the discharging section D[m], to the detection circuit 33, in response to the print signal SI. The piezoelectric element PZ[m] and upper electrode Zu[m] will be described below with reference to FIG. 3.

The detection circuit 33 creates a vibration waveform signal Vd[m] according to the detected potential signal Vout[m]. The vibration waveform signal Vd[m] indicates the waveform of the vibration of the discharging section D[m], the vibration being generated when the discharging section D[m] is driven by the supply driving signal Vin[m].

The ink jet printer 1 in this embodiment has the inspecting unit 6 as illustrated in FIG. 1. The inspecting unit 6 inspects the discharging state of the ink in the discharging section D[m] in response to the vibration waveform signal Vd[m], after which the inspecting unit 6 creates discharging state information NVT, which indicates a result of the inspection.

In the description below, processing related to the inspection of the discharging state of the ink in the discharging section D[m] will sometimes be referred to as discharging state inspection processing. Also, in the description below, the discharging section D[m] eligible for inspection in discharging state inspection processing will sometimes be referred to as the to-be-inspected discharging section DK.

Figure 2:
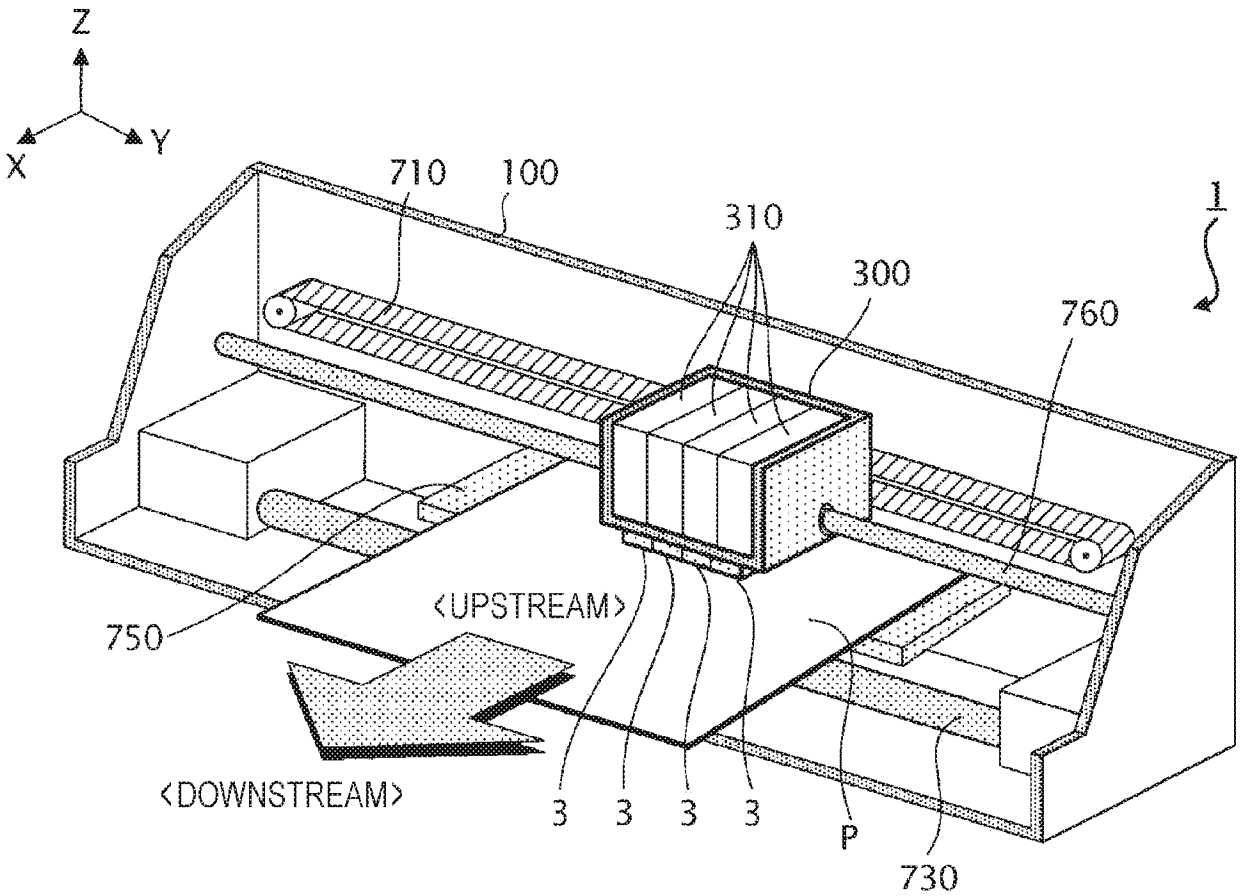
FIG. 2 is a perspective view schematically illustrating an example of the internal structure of the ink jet printer.

FIG. 2 is a perspective view schematically illustrating an example of the internal structure of the ink jet printer 1.

In this embodiment, it will be assumed that the ink jet printer 1 is a serial printer, as illustrated in FIG. 2. Specifically, during the execution of print processing, the ink jet printer 1 causes the discharging section D to discharge ink while transporting recording paper P in a sub-scanning direction and bidirectionally moving the head unit 3 in a main scanning direction crossing the sub-scanning direction so that a dot matching print data Img is formed on the recording paper P.

In the description below, the +X direction and the −X direction opposite to the +X direction will be collectively referred to as the X-axis direction, the +Y direction crossing the X-axis direction and the −Y direction opposite to the +Y direction will be collectively referred to as the Y-axis direction, and the +Z direction crossing the X-axis direction and Y-axis direction and the −Z direction opposite to the +Z direction will be collectively referred to as the Z-axis direction. In this embodiment, a direction away from the −X-direction side, which is the upstream, and toward the +X-direction side, which is the downstream, is the sub-scanning direction, and the +Y direction and +Y direction are the main scanning direction, as illustrated in FIG. 2.

The ink jet printer 1 in this embodiment has a case 100 and a carriage 300, which can bidirectionally move in the case 100 in the Y-axis direction and in which one or a plurality of head units 3 are mounted, as illustrated in FIG. 2.

As described above, the ink jet printer 1 in this embodiment has the transport unit 7. During the execution of print processing, the transport unit 7 bidirectionally moves the carriage 300 in the Y-axis direction and transports recording paper P in the +X direction to change the relative position of the recording paper P with respect to the head unit 3 so that ink can be landed over the recording paper P. The transport unit 7 has a carriage transport mechanism 71 that bidirectionally moves the carriage 300 and a medium transport mechanism 72 that transports recording paper P, as illustrated in FIG. 1. The transport unit 7 also has a carriage guide axis 760 that supports the carriage 300 so as to be bidirectionally movable in the Y-axis direction as well as a timing belt 710 fixed to the carriage 300, the timing belt 710 being driven by the carriage transport mechanism 71, as illustrated in FIG. 2. Therefore, the transport unit 7 can bidirectionally move the head unit 3 in the Y-axis direction along the carriage guide axis 760, together with the carriage 300. The transport unit 7 also has a platen 750 disposed on the −Z-direction side of the carriage 300 as well as a transport roller 730 that rotates when the medium transport mechanism 72 is driven to transport the recording paper P on the platen 750 in the +X direction.

In this embodiment, it will be assumed that the carriage 300 stores four ink cartridges 310 in one-to-one correspondence with inks in four colors, cyan, magenta, yellow and black, as illustrated in FIG. 2. In this embodiment, it will also be assumed as an example that the ink jet printer 1 has four head units 3 in one-to-one correspondence with four ink cartridges 310. Each discharging section D receives a supply of ink from the ink cartridge 310 corresponding to the head unit 3 in which the discharging section D is disposed. Thus, the interior of the discharging section D is filled with the supplied ink, making the discharging section D ready for discharging the ink from a nozzle N. The ink cartridges 310 may be disposed outside the carriage 300.

Now, the operation of the control unit 2 during the execution of print processing will be outlined.

In the execution of print processing, the control unit 2 first stores, in the storage unit 5, print data Img supplied from the host computer. The control unit 2 then creates a print signal SI or another signal that controls the head unit 3, a waveform specification signal dCom or another signal that controls the driving signal creating unit 4, and a signal that controls the transport unit 7, according to various types of data, such as print data Img, stored in the storage unit 5. According to the print signal SI and other various signals and to various data stored in the storage unit 5, the control unit 2 controls the transport unit 7 so that the relative position of the recording paper P with respect to the head unit 3 and also controls the driving signal creating unit 4 and supply circuit 31 so that the discharging section D is driven. The control unit 2 thereby adjusts whether to discharge ink from the discharging section D, the amount of ink to be discharged, a timing to discharge ink, and the like, and controls individual sections in the ink jet printer 1 so that an image is formed on the recording paper P in correspondence with the print data Img.

As described above, the ink jet printer 1 in this embodiment also executes discharging state inspection processing.

Discharging state inspection processing is a series of processing executed by the ink jet printer 1. Specifically, discharging state inspection processing includes processing in which the control unit 2 selects a to-be-inspected discharging section DK eligible for discharging state inspection processing, processing in which the driving signal creating unit 4 creates a driving signal Com according to a waveform specification signal dCom output from the control unit 2, processing in which, to drive the to-be-inspected discharging section DK, the supply circuit 31 supplies a driving signal Com output from the driving signal creating unit 4 to the to-be-inspected discharging section DK as a supply driving signal Vin[m] under control of the control unit 2, processing in which the detection circuit 33 creates a vibration waveform signal Vd[m] according to a detected potential signal Vout[m] that indicates vibration generated in the to-be-inspected discharging section DK, and processing in which the inspecting unit 6 inspects the discharging state of the ink in the to-be-inspected discharging section DK according to the vibration waveform signal Vd[m] and creates discharging state information NVT indicating a result of the inspection.

In the inspection, executed by the inspecting unit 6, of the discharging state of the ink in the discharging section D, the inspecting unit 6 decides whether ink is being normally discharged from the discharging section D, that is, decides whether the discharging section D has a discharging failure. A discharging failure is the generic name for states in which the discharging state of the ink in the discharging section D is abnormal, that is, ink cannot be normally discharged from the nozzle N in the discharging section D. Examples of discharging failures include a state in which ink cannot be discharged from the discharging section D, a state in which the discharging section D discharges ink by an amount different from the amount of ink to be discharged, the amount being stipulated by the driving signal Com, and a state in which the discharging section D discharges ink at a speed different from an ink discharging speed stipulated by the driving signal Com.

Although described later in detail, the ink jet printer 1 in this embodiment executes micro-vibration processing in which the discharging section D is driven to the extent that ink is not discharged from the discharging section D to agitate the ink in the discharging section D, which prevents the ink in the discharging section D from becoming viscous.

2. OUTLINE OF THE RECORDING HEAD AND DISCHARGING SECTION

The recording head 32 and the discharging section D disposed in the recording head 32 will be described with reference to FIGS. 3 and 4.

Figure 3:
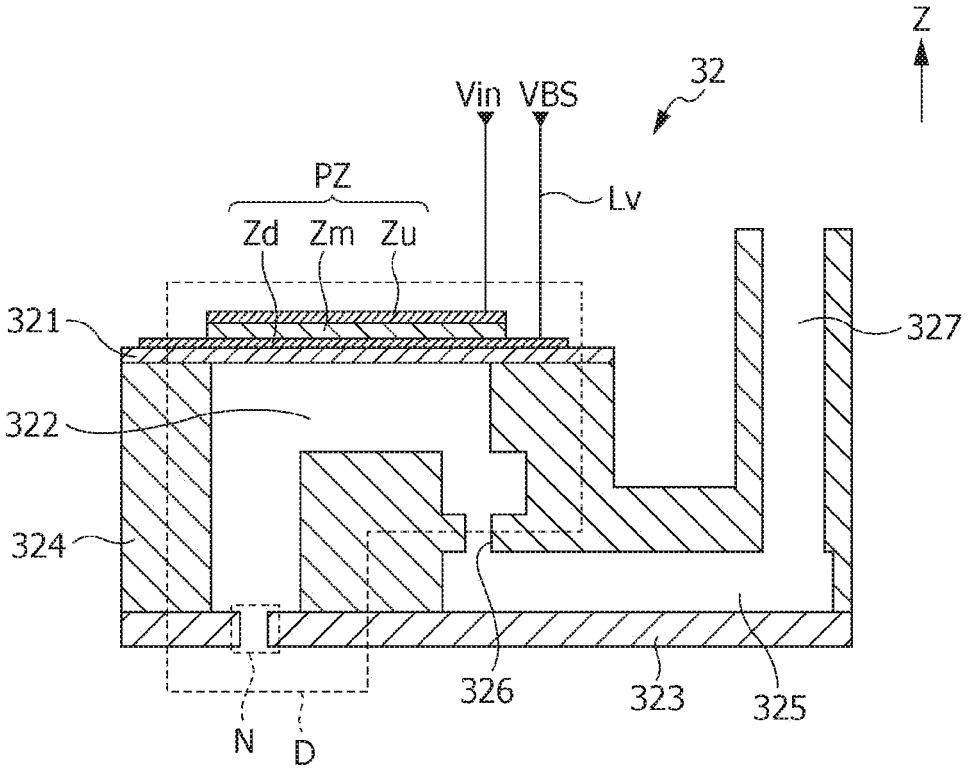
FIG. 3 illustrates an example of the structure of a discharging section.

FIG. 3 is a partial cross-sectional view schematically illustrating the recording head 32 when the recording head 32 is cut so as to include the discharging section D.

The discharging section D has a piezoelectric element PZ, a cavity 322 internally filled with ink, the nozzle N communicating with the cavity 322, and a vibrating plate 321, as illustrated in FIG. 3. When the piezoelectric element PZ is driven by a supply driving signal Vin, the discharging section D causes the ink in the cavity 322 to be discharged from the nozzle N. The cavity 322 is space defined by a cavity plate 324, a nozzle plate 323 in which the nozzle N is formed, and the vibrating plate 321. The cavity 322 communicates with a reservoir 325 through an ink supply inlet 326. The reservoir 325 communicates with the ink cartridge 310 corresponding to the discharging section D through the ink intake 327. The piezoelectric element PZ has an upper electrode Zu, a lower electrode Zd, and a piezoelectric body Zm disposed between the upper electrode Zu and the lower electrode Zd. The lower electrode Zd is electrically coupled to a power feeder Lv set to a potential VBS. When a supply driving signal Vin is supplied to the upper electrode Zu and a voltage is applied across the upper electrode Zu and lower electrode Zd, the piezoelectric element PZ is displaced in the +Z direction or −Z direction according to the applied voltage. As a result, the piezoelectric element PZ vibrates. The lower electrode Zd is bonded to the vibrating plate 321. Therefore, when the piezoelectric element PZ vibrates in response to the supply driving signal Vin, the vibrating plate 321 also vibrates. The volume of the cavity 322 and pressure in the cavity 322 change due to the vibration of the vibrating plate 321, discharging the ink in the cavity 322 from the nozzle N.

Figure 4:
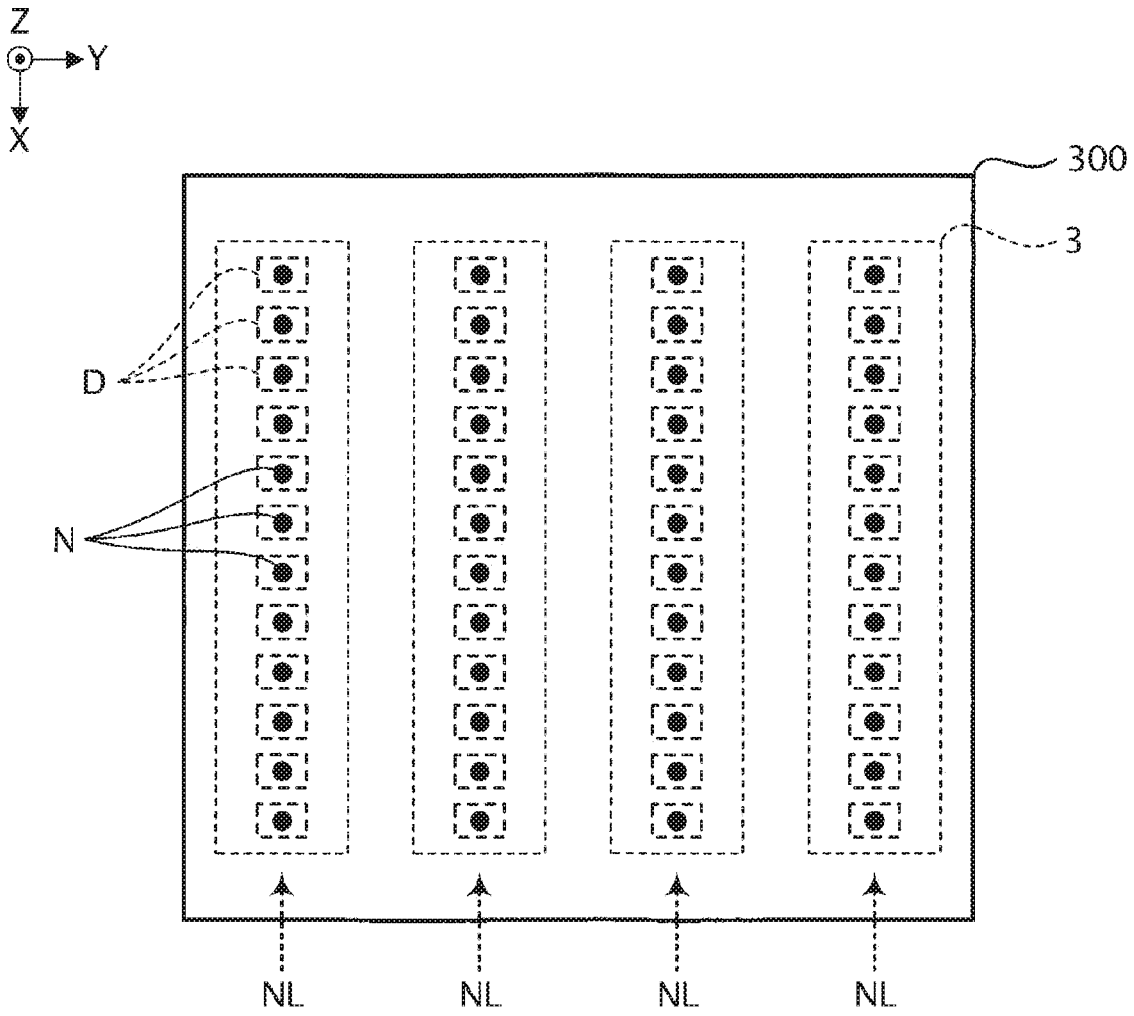
FIG. 4 illustrates the layout of nozzles in a head unit.

FIG. 4 illustrates an example of the layout of four head units 3 mounted in the carriage 300 and a total of 4 M nozzles N provided in the four head units 3 when the ink jet printer 1 is viewed from the −Z direction in plan view. As illustrated in FIG. 4, a nozzle row NL is provided in each head unit 3 disposed in the carriage 300. The nozzle row NL is a plurality of nozzles N disposed in a row so as to extend in a predetermined direction. In this embodiment, it will be assumed as an example that each nozzle row NL is composed of M nozzles N placed so as to extend in the X-axis direction.

3. STRUCTURE OF THE HEAD UNIT

The structure of the head unit 3 will be described below with reference to FIG. 5.

Figure 5:
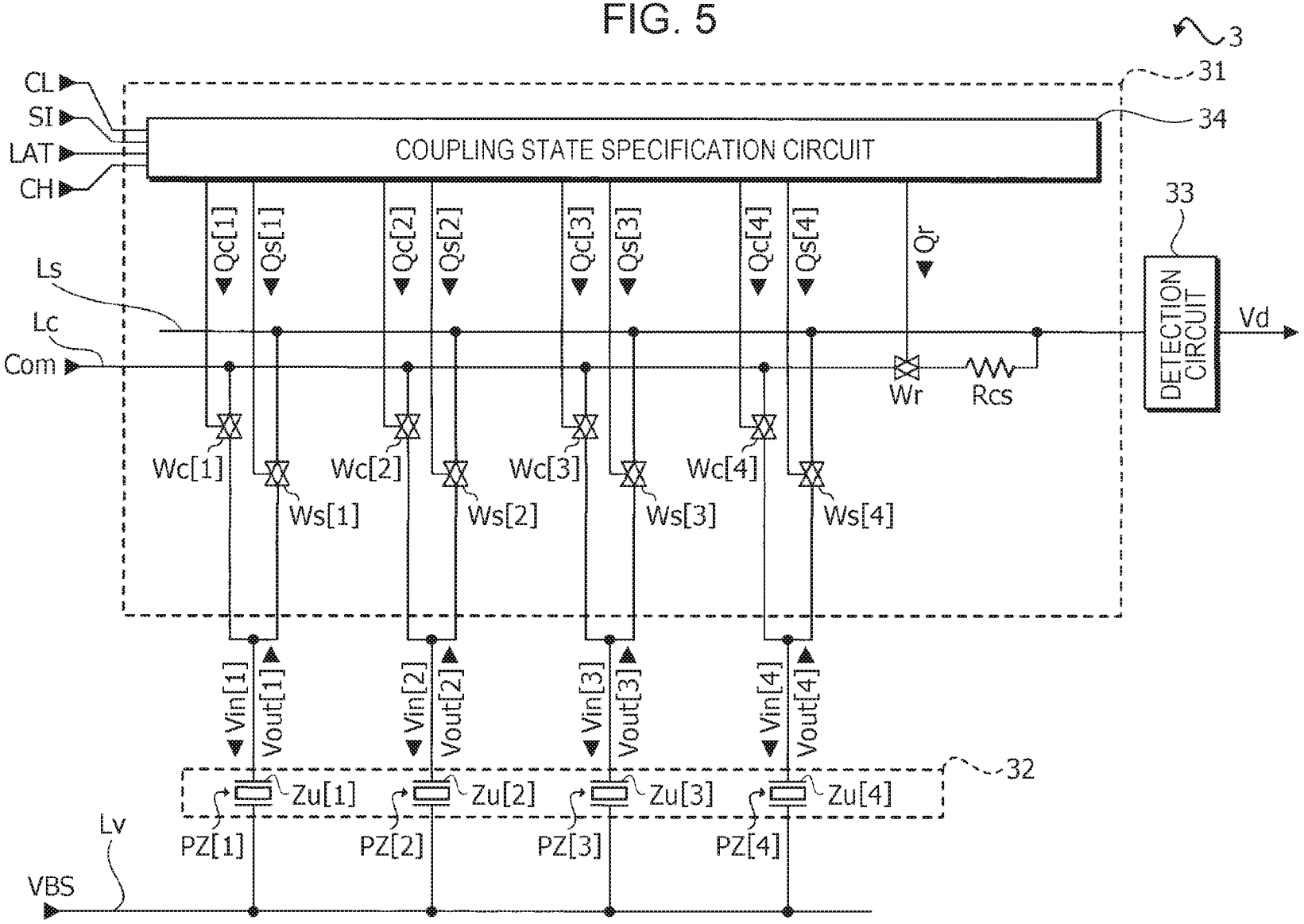
FIG. 5 is a block diagram illustrating an example of the structure of the head unit.

FIG. 5 is a block diagram illustrating an example of the structure of the head unit 3. As described above, the head unit 3 has the supply circuit 31, recording head 32, and detection circuit 33. The head unit 3 also has a line Lc through which a driving signal Com is supplied from the driving signal creating unit 4, a line Ls through which a detected potential signal Vout[m] is supplied to the detection circuit 33, and the power supply line Lv through which a potential VBS is supplied.

As illustrated in FIG. 5, the supply circuit 31 has M switches Wc[1] to Wc[M], M switches Ws[1] to Ws[M], a switch Wr, a resistor Rcs, and a coupling state specification circuit 34 that specifies the coupling state of each switch.

The coupling state specification circuit 34 creates a coupling state specification signal Qc[m] that specifies whether to turn on or off the switch Wc[m], a coupling state specification signal Qs[m] that specifies whether to turn on or off the switch Ws[m], and a coupling state specification signal Qr that specifies whether to turn on or off the switch Wr, according to at least part of a print signal SI, latch signal LAT, and change signal CH supplied from the control unit 2.

The switch Wc[m] selectively creates or breaks continuity between the line Lc and the upper electrode Zu[m] of the piezoelectric element PZ[m] disposed in the discharging section D[m], according to the state of the coupling state specification signal Qc[m]. In this embodiment, the switch Wc[m] is turned on when the coupling state specification signal Qc[m] is high and is turned off when the signal is low. The switch Ws[m] selectively creates or breaks continuity between the line Ls and the upper electrode Zu[m] of the piezoelectric element PZ[m] disposed in the discharging section D[m], according to the state of the coupling state specification signal Qs[m]. In this embodiment, the switch Ws[m] is turned on when the coupling state specification signal Qs[m] is high and is turned off when the signal is low. The switch Wr selectively creates or breaks continuity between the line Lc and the line Ls, according to the state of the coupling state specification signal Qr. In this embodiment, the switch Wr is turned on when the coupling state specification signal Qr is high and is turned off when the signal is low.

The resistor Rcs is coupled in series with the switch Wr between the line Lc and the line Ls.

The detection circuit 33 receives, through the line Ls, a detected potential signal Vout[m] that indicates the potential of the piezoelectric element PZ[m] in the discharging section D[m] driven as the to-be-inspected discharging section DK. The detection circuit 33 then creates a vibration waveform signal Vd[m] according to the received detected potential signal Vout[m].

4. OPERATION OF THE HEAD UNIT

The operation of the head unit 3 will be described below with reference to FIGS. 6 to 13.

In this embodiment, for the execution of print processing by the ink jet printer 1, one or a plurality of unit print periods TP are set as an operation period for the ink jet printer 1. In each unit print period TP, the ink jet printer 1 in this embodiment can drive each discharging section D for print processing.

Figures 6, 7:
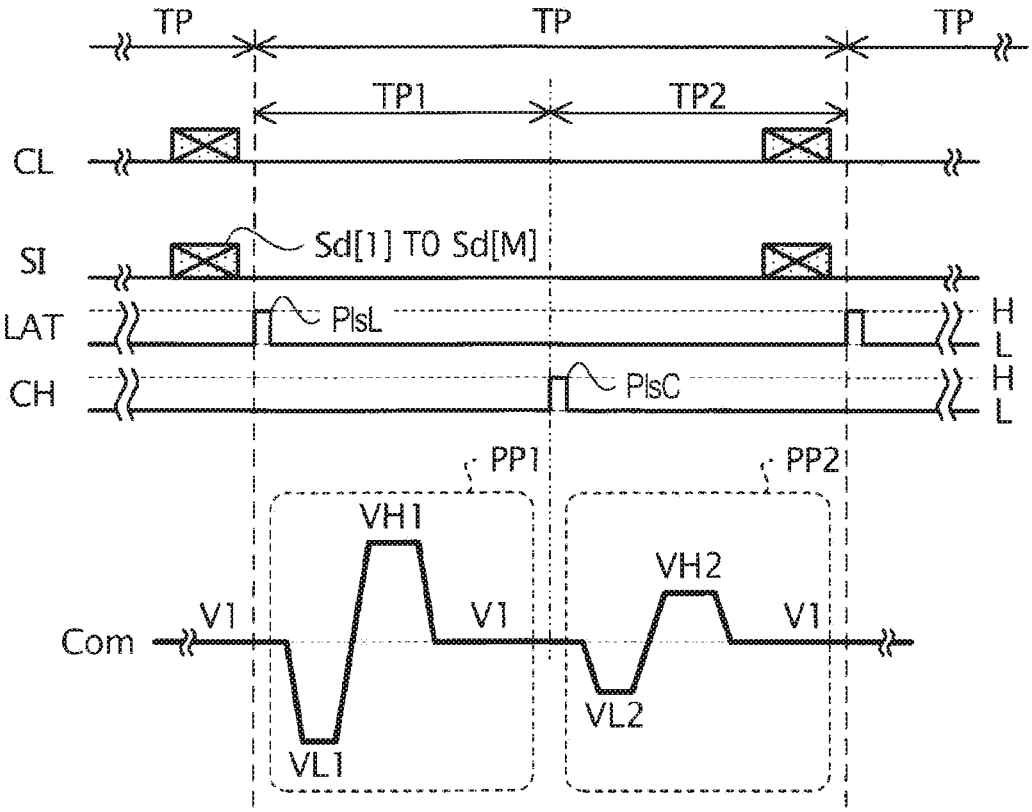
FIG. 6 is a timing diagram illustrating an example of the operation of the ink jet printer.
FIG. 7 indicates an example of an individual specification signal.

FIG. 6 is a timing diagram illustrating the operation of the ink jet printer 1 in the unit print period TP.

As illustrated in FIG. 6, the control unit 2 outputs a latch signal LAT having pulses PlsL. The control unit 2 thereby stipulates the unit print period TP as a period starting from the rising edge of a pulse PlsL and continuing to the rising edge of a next pulse PlsL. In the unit print period TP, the control unit 2 also outputs a change signal CH having pulses PlsC. The control unit 2 divides the unit print period TP into a control period TP1 starting from the rising edge of the pulse PlsL and continuing to the rising edge of a pulse PlsC and a control period TP2 starting from the rising edge of the pulse PlsC and continuing to the rising edge of the next pulse PlsL.

The print signal SI in this embodiment includes M individual specification signals Sd[1] to Sd[M] in one-to-one correspondence with the M discharging sections D[1] to D[M]. When the ink jet printer 1 executes print processing, the individual specification signal Sd[m] specifies a mode in which the discharging section D[m] is driven in each unit print period TP.

As illustrated in FIG. 6, the control unit 2 supplies a print signal SI including individual specification signals Sd[1] to Sd[M] to the coupling state specification circuit 34 in synchronization with a clock signal CL before a unit print period TP, during which print processing is executed, starts. In the unit print period TP, the coupling state specification circuit 34 creates coupling state specification signals Qc[m] and Qs[m] according to the individual specification signal Sd[m].

In this embodiment, it will be assumed that the discharging section D[m] can create a large dot, a medium dot smaller than the large dot, and a small dot smaller than the medium dot. In this embodiment, it will also be assumed that, in the unit print period TP, the individual specification signal Sd[m] can take any one of the following four values: a value of 1 by which the discharging section D[m] is specified as a large-dot forming discharging section DP1 that discharges ink by an amount equivalent to a large dot, a value of 2 by which the discharging section D[m] is specified as a medium-dot forming discharging section DP2 that discharges ink by an amount equivalent to a medium dot, a value of 3 by which the discharging section D[m] is specified as a small-dot forming discharging section DP3 that discharges ink by an amount equivalent to a small dot, and a value of 4 by which the discharging section D[m] is specified as a dot non-forming discharging section DP0 that does not discharge ink.

In this embodiment, when the ink jet printer 1 performs print processing, the control unit 2 outputs a waveform specification signal dCom by which a driving signal Com is set as a signal having a waveform PP1 formed in the control period TP1 and a waveform PP2 formed in the control period TP2, as illustrated in FIG. 6. In this embodiment, the waveforms PP1 and PP2 are determined so that the difference between the maximum potential VH1 and minimum potential VL1 of the waveform PP1 is larger than the difference between the maximum potential VH2 and minimum potential VL2 of the waveform PP2. Specifically, when a driving signal Com having the waveform PP1 is to be supplied to the discharging section D[m], the waveform PP1 is determined so that the discharging section D[m] is driven in a mode in which the discharging section D[m] discharges ink by an amount equivalent to a medium dot. When a driving signal Com having the waveform PP2 is to be supplied to the discharging section D[m], the waveform PP2 is determined so that the discharging section D[m] is driven in a mode in which the discharging section D[m] discharges ink by an amount equivalent to a small dot. In this embodiment, at the start and end of the unit print period TP, the potentials of the waveforms PP1 and PP2 are set to a reference potential V1.

FIG. 7 indicates a relationship among the individual specification signal Sd[m], coupling state specification signal Qc[m], and coupling state specification signal Qs[m] in the unit print period TP.

As indicated in FIG. 7, when, in the unit print period TP, the individual specification signal Sd[m] indicates the value 1 by which the discharging section D[m] is specified as the large-dot forming discharging section DP1, the coupling state specification circuit 34 keeps the coupling state specification signal Qc[m] high over the unit print period TP. In this case, the switch Wc[m] is turned on over the unit print period TP. In the unit print period TP, therefore, the discharging section D[m] is driven by the supply driving signal Vin[m] having the waveforms PP1 and PP2, and discharges ink by an amount equivalent to a large dot.

As indicated in FIG. 7, when, in the unit print period TP, the individual specification signal Sd[m] indicates the value 2 by which the discharging section D[m] is specified as the medium-dot forming discharging section DP2, the coupling state specification circuit 34 keeps the coupling state specification signal Qc[m] high only in the control period TP1. In this case, the switch Wc[m] is turned on only in the control period TP1. In the unit print period TP, therefore, the discharging section D[m] is driven by the supply driving signal Vin[m] having the waveforms PP1, and discharges ink by an amount equivalent to a medium dot.

As indicated in FIG. 7, when, in the unit print period TP, the individual specification signal Sd[m] indicates the value 3 by which the discharging section D[m] is specified as the small-dot forming discharging section DP3, the coupling state specification circuit 34 keeps the coupling state specification signal Qc[m] high only in the control period TP2. In this case, the switch Wc[m] is turned on only in the control period TP2. In the unit print period TP, therefore, the discharging section D[m] is driven by the supply driving signal Vin[m] having the waveforms PP2, and discharges ink by an amount equivalent to a small dot.

As indicated in FIG. 7, when, in the unit print period TP, the individual specification signal Sd[m] indicates the value 4 by which the discharging section D[m] is specified as the dot non-forming discharging section DPO, the coupling state specification circuit 34 keeps the coupling state specification signal Qc[m] low over the unit print period TP. In this case, the switch Wc[m] is turned off over the unit print period TP. In the unit print period TP, therefore, the discharging section D[m] is not driven by the Com, and thereby does not discharge ink.

In this embodiment, for the execution of micro-vibration processing by the ink jet printer 1, one or a plurality of unit micro-vibration periods TB are set as an operation period for the ink jet printer 1. In each unit micro-vibration period TB, the ink jet printer 1 in this embodiment can drive each discharging section D for micro-vibration processing.

Figures 8, 9:
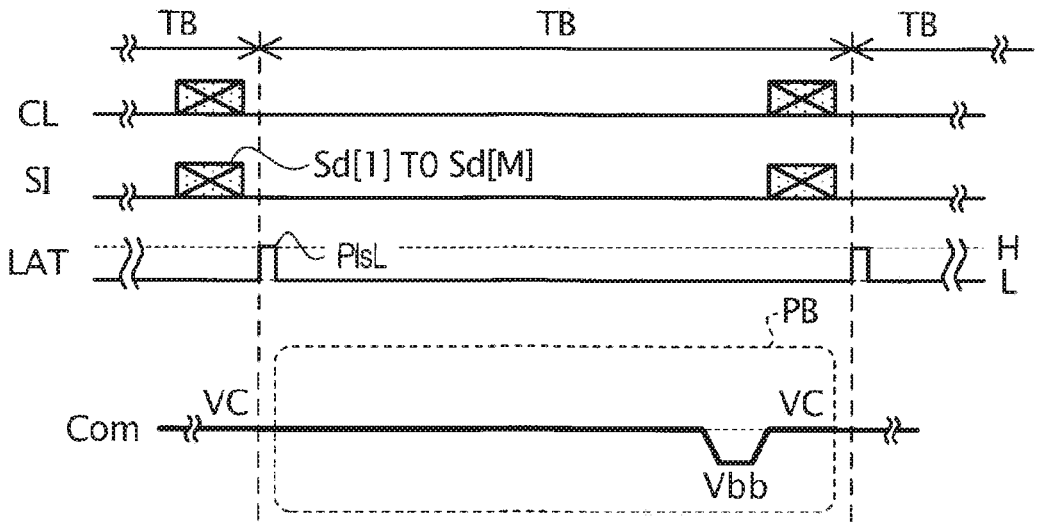
FIG. 8 is a timing diagram illustrating an example of the operation of the ink jet printer.
FIG. 9 indicates an example of the individual specification signal.

FIG. 8 is a timing diagram illustrating the operation of the ink jet printer 1 in the unit micro-vibration period TB.

In this embodiment, the control unit 2 uses pulses PlsL included in the latch signal LAT to stipulate the unit micro-vibration period TB for the execution of micro-vibration processing by the ink jet printer 1, as illustrated in FIG. 8. The unit micro-vibration period TB and unit print period TP may have the same length in time or may have different lengths in time.

In this embodiment, when the ink jet printer 1 executes micro-vibration processing, the control unit 2 outputs a waveform specification signal dCom to set a driving signal Com as a signal having a waveform PB formed in the unit micro-vibration period TB. In this embodiment, when a driving signal Com having the waveform PB is to be supplied to the discharging section D[m], the waveform PB is set so that the discharging section D[m] is driven to the extent that ink is not discharged. Specifically, in this embodiment, at the start and end of the unit micro-vibration period TB, the potentials of the waveform PB is set to a reference potential VC. In this embodiment, it will be assumed as an example that the waveform PB changes from the reference potential VC to a potential Vbb, which differs from the reference potential VC, in the unit micro-vibration period TB, after which the waveform PB changes from the potential Vbb back to the reference potential VC.

Although described later in detail, the reference potential VC is the generic name for the reference potential V1 and a reference potential V2, which is higher than the reference potential V1. That is, in this embodiment, it will be assumed that there are two types of potentials that the driving signal Com can have at the start and end of the unit micro-vibration period TB, one of which is the reference potential V1 and the other of which is the reference potential V2. In the description below, one of the reference potential V1 and reference potential V2 will sometimes be referred to as the reference potential VC1 and the other of them will sometimes be referred to as the reference potential VC2. For example, when the reference potential VC is the reference potential V1, the potential Vbb may be lower than the reference potential V1 by a predetermined potential; when the reference potential VC is the reference potential V2, the potential Vbb may be lower than the reference potential V2 by a predetermined potential.

FIG. 9 indicates a relationship among the individual specification signal Sd[m], coupling state specification signal Qc[m], and coupling state specification signal Qs[m] in the unit micro-vibration period TB.

In this embodiment, it will be assumed that, in the unit micro-vibration period TB, the individual specification signal Sd[m] can take any one of the following two values: a value of 1 by which the discharging section D[m] is specified as a micro-vibration discharging section DB1 eligible for micro-vibration processing, and a value of 2 by which the discharging section D[m] is specified as a non-target micro-vibration discharging section DB0 not eligible for micro-vibration processing.

As indicated in FIG. 9, when, in the unit micro-vibration period TB, the individual specification signal Sd[m] indicates the value 1 by which the discharging section D[m] is specified as the micro-vibration discharging section DB1, the coupling state specification circuit 34 keeps the coupling state specification signal Qc[m] high over the unit micro-vibration period TB. In this case, the switch Wc[m] is turned on over the unit micro-vibration period TB. In the unit micro-vibration period TB, therefore, the discharging section D[m] is driven by the supply driving signal Vin[m] having the waveform PB and undergoes micro-vibration to the extent that ink is not discharged from the nozzle N.

As indicated in FIG. 9, when, in the unit micro-vibration period TB, the individual specification signal Sd[m] indicates the value 2 by which the discharging section D[m] is specified as the non-target micro-vibration discharging section DB0, the coupling state specification circuit 34 keeps the coupling state specification signal Qc[m] low over the unit micro-vibration period TB. In this case, the switch Wc[m] is turned off over the unit micro-vibration period TB. In the unit micro-vibration period TB, therefore, the discharging section D[m] is not driven by the driving signal Com, and thereby does not vibrate.

In this embodiment, for the execution of discharging state inspection processing by the ink jet printer 1, an inspection preparation period TTM, which includes a unit preparation period TM1 and a unit preparation period TM2 following the unit preparation period TM1, is set as an operation period for the ink jet printer 1. An inspection period TTK, which includes J unit inspection periods TK, is further set so as to follow the inspection preparation period TTM, where J is a natural number equal to or greater than 1.

In the description below, the unit preparation period TM1 and unit preparation period TM2 will sometimes be collectively referred to as the inspection preparation period TM. In the description below, of the J unit inspection periods TK included in the inspection period TTK, a j-th unit inspection period TK will sometimes be referred to as the unit inspection period TK[j], where j is a natural number in the range from 1 to J.

Figure 10:
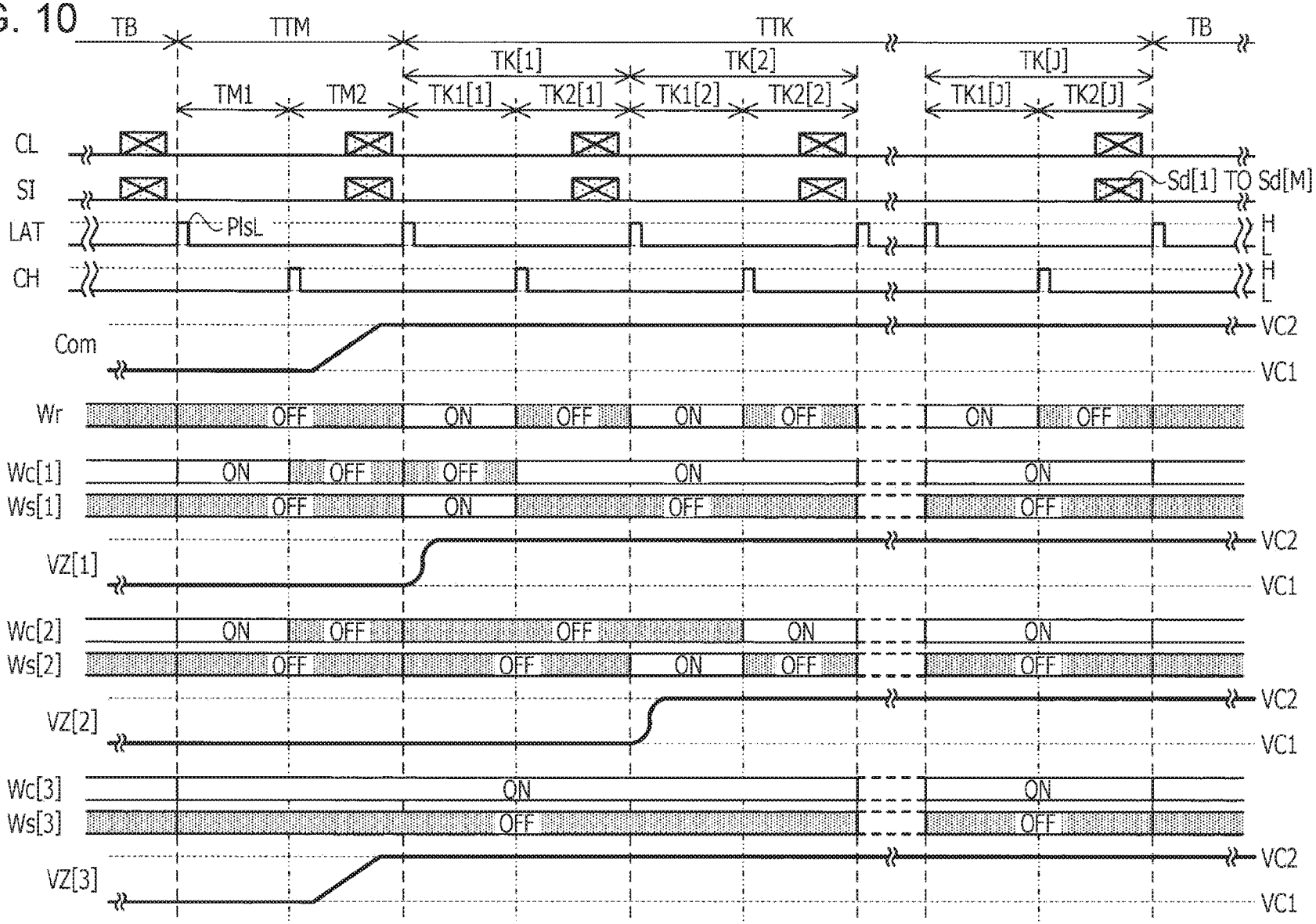
FIG. 10 is a timing diagram illustrating an example of the operation of the ink jet printer.

FIG. 10 is a timing diagram illustrating the operation of the ink jet printer 1 in the inspection preparation period TTM and inspection period TTK.

In this embodiment, the control unit 2, in the execution of discharging state inspection processing by the ink jet printer 1, uses pulses PlsL included in the latch signal LAT or pulses PlsC included in the change signal CH to stipulate the unit preparation period TM and unit inspection period TK[j], as illustrated in FIG. 10. The control unit 2 uses the change signal CH to divide the unit inspection period TK[j] into a control period TK1[j] and a control period TK2[j]. The unit preparation period TM and unit print period TP may have the same length in time or may have different lengths in time. The unit inspection period TK[j] and unit print period TP may have the same length in time or may have different lengths in time.

In this embodiment, when the ink jet printer 1 executes discharging state inspection processing, the control unit 2 outputs a waveform specification signal dCom that specifies that the potential of the driving signal Com is to be maintained at the reference potential VC1 in the unit preparation period TM1, is to change from the reference potential VC1 to the reference potential VC2 in the unit preparation period TM2, and is to be maintained at the reference potential VC2 in the inspection period TTK. FIG. 10 exemplifies a case in which the reference potential VC2 is higher than the reference potential VC1. That is, FIG. 10 exemplifies a case in which the reference potential VC1 is the reference potential V1 and the reference potential VC2 is the reference potential V2. However, FIG. 10 is just an example. The reference potential VC1 may be the reference potential V2 and the reference potential VC2 may be reference potential V1.

As illustrated in FIG. 10, the control unit 2 controls the coupling state specification circuit 34 so that the coupling state specification signal Qr goes high in the control period TK1[j] and goes low in the inspection preparation period TTM and control period TK2[j]. Therefore, the switch Wr is turned on in the control period TK1[j] and is turned off in the inspection preparation period TTM and control period TK2[j].

FIG. 11 indicates a relationship among the individual specification signal Sd[m], coupling state specification signal Qc[m], and coupling state specification signal Qs[m] in the inspection preparation period TTM.

In this embodiment, it will be assumed that, in the unit preparation period TM, the individual specification signal Sd[m] can take any one of the following two values: a value of 1 by which the discharging section D[m] is specified as the to-be-inspected discharging section DK eligible for discharging state inspection processing, and a value of 2 by which the discharging section D[m] is specified as a non-target to-be-inspected discharging section DK0 not eligible for discharging state inspection processing.

As indicated in FIG. 11, when, in the inspection preparation period TTM, the individual specification signal Sd[m] indicates the value 1 by which the discharging section D[m] is specified as the to-be-inspected discharging section DK, the coupling state specification circuit 34 keeps the coupling state specification signal Qc[m] high only in the unit preparation period TM1. In this case, the switch Wc[m] is turned only in the unit preparation period TM1, and a supply driving signal Vin[m] at the reference potential VC1 is supplied to the upper electrode Zu[m] of the discharging section D[m]. The potential VZ[m] of the upper electrode Zu[m] is maintained at the reference potential VC1 over the unit preparation periods TM1 and TM2.

When, in the inspection preparation period TTM, the individual specification signal Sd[m] indicates the value 2 by which the discharging section D[m] is specified as the non-target to-be-inspected discharging section DK0, the coupling state specification circuit 34 keeps the coupling state specification signal Qc[m] high over the inspection preparation period TTM. In this case, the switch Wc[m] is turned on over the inspection preparation period TTM. A supply driving signal Vin[m] the potential of which changes from the reference potential VC1 to the reference potential VC2 is supplied to the upper electrode Zu[m] in the discharging section D[m]. The potential VZ[m] of the upper electrode Zu[m] changes by following a change in the potential of the driving signal Com and is set to the reference potential VC2 in the unit preparation period TM2.

FIG. 12 indicates a relationship among the individual specification signal Sd[m], coupling state specification signal Qc[m], and coupling state specification signal Qs[m] in the unit inspection period TK[j].

In this embodiment, it will be assumed that, in the unit inspection period TK[j], the individual specification signal Sd[m] can take any one of the following four values: a value of 1 by which the discharging section D[m] is specified as a planned-to-be-inspected discharging section DK1, a value of 2 by which the discharging section D[m] is specified as an inspection-in-progress discharging section DK2, a value of 3 by which the discharging section D[m] is specified as an inspected discharging section DK3, and a value of 4 by which the discharging section D[m] is specified as the non-target to-be-inspected discharging section DK0.

The planned-to-be-inspected discharging section DK1, which is one of the to-be-inspected discharging sections DK, is a discharging section D for which the discharging state is planned to be inspected in a unit inspection period TK after the unit inspection period TK[j]. The inspection-in-progress discharging section DK2, which is one of the to-be-inspected discharging sections DK, is a discharging section D for which the discharging state is being inspected in the unit inspection period TK[j]. The inspected discharging section DK3, which is one of the to-be-inspected discharging sections DK, is a discharging section D for which the discharging state was already inspected in a unit inspection period TK before the unit inspection period TK[j]. The non-target to-be-inspected discharging section DK0 is a discharging section D not eligible for the inspection of the discharging state, as described above. When the discharging section D[m] is a to-be-inspected discharging section DK eligible for the inspection of the discharging state in the inspection period TTK, the discharging section D[m] changes from the planned-to-be-inspected discharging section DK1 to the inspection-in-progress discharging section DK2 and then to the inspected discharging section DK3 in the inspection period TTK.

As indicated in FIG. 12, when, in the unit inspection period TK[j], the individual specification signal Sd[m] indicates the value 1 by which the discharging section D[m] is specified as the planned-to-be-inspected discharging section DK1, the coupling state specification circuit 34 keeps the coupling state specification signals Qc[m] and Qs[m] low over the unit inspection period TK[j]. In this case, the coupling state specification signals Qc[m] and Qs[m] are kept low in the unit inspection periods TK[1] to TK[j-1] as well. That is, in this case, the switches Wc[m] and Ws[m] are turned off over the unit inspection periods TK[1] to TK[j]. In this case, therefore, the potential VZ[m] of the upper electrode Zu[m] included in the discharging section D[m] specified as the planned-to-be-inspected discharging section DK1 keeps the reference potential VC1, which is the potential at the end of the unit preparation period TM2.

As indicated in FIG. 12, when, in the unit inspection period TK[j], the individual specification signal Sd[m] indicates the value 2 by which the discharging section D[m] is specified as the inspection-in-progress discharging section DK2, the coupling state specification circuit 34 keeps the coupling state specification signal Qs[m] high in the control period TK1[j]. In this case, the switch Ws[m] is turned on in the control period TK1[j]. The switch Wr is turned on in the unit inspection period TK1[j] as described above. In the control period TK1[j], therefore, a driving signal Com is supplied from the line Lc through the switch Wr, line Ls, and switch Ws[m] to the upper electrode Zu[m] in the discharging section D[m] specified as the inspection-in-progress discharging section DK2.

At the start of the control period TK1[j], the potential VZ[m] of the upper electrode Zu[m] in the discharging section D[m] specified as the inspection-in-progress discharging section DK2 is the reference potential VC1. At the end of the control period TK1[j], however, the potential VZ[m] is set to reference potential VC2. This is because a driving signal Com set to the reference potential VC2 is supplied in the control period TK1[j]. That is, the potential VZ[m] of the upper electrode Zu[m] in the discharging section D[m] specified as the inspection-in-progress discharging section DK2 changes from the reference potential VC1 to the reference potential VC2 in the control period TK1[j]. In the control period TK1[j], therefore, the piezoelectric element PZ[m] in the discharging section D[m] specified as the inspection-in-progress discharging section DK2 undergoes vibration due to variations in the potential of the upper electrode Zu[m]. In the control period TK1[j], the detection circuit 33 detects, as the detected potential signal Vout[m], a change in the potential VZ[m], the change being caused by the vibration of the piezoelectric element PZ[m] in the discharging section D[m] specified as the inspection-in-progress discharging section DK2, through the line Ls.

As indicated in FIG. 12, when, in the unit inspection period TK[j], the individual specification signal Sd[m] indicates the value 2 by which the discharging section D[m] is specified as the inspection-in-progress discharging section DK2, the coupling state specification circuit 34 keeps the coupling state specification signal Qc[m] high in the control period TK2[j]. In this case, the switch Wc[m] is turned on in the control period TK2[j]. In the control period TK2[j], therefore, a driving signal Com is supplied from the line Lc through the switch Wc[m] to the upper electrode Zu[m] in the discharging section D[m] specified as the inspection-in-progress discharging section DK2. At the start of the control period TK2[j], the potential VZ[m] of the upper electrode Zu[m] in the discharging section D[m] specified as the inspection-in-progress discharging section DK2 is the reference potential VC2 and the potential of the driving signal Com is also the reference potential VC2. In the control period TK2[j], therefore, the potential VZ[m] of the upper electrode Zu[m] in the discharging section D[m] specified as the inspection-in-progress discharging section DK2 is maintained at the reference potential VC2.

As indicated in FIG. 12, when, in the unit inspection period TK[j], the individual specification signal Sd[m] indicates the value 3 by which the discharging section D[m] is specified as the inspected discharging section DK3, the coupling state specification circuit 34 keeps the coupling state specification signal Qc[m] high in the unit inspection period TK[j]. In this case, the switch We [m] is turned on in the unit inspection period TK[j]. In the unit inspection period TK[j], therefore, a driving signal Com is supplied from the line Lc through the switch Wc[m] to the upper electrode Zu[m] in the discharging section D[m] specified as the inspected discharging section DK3. In the control period TK2[j], therefore, the potential VZ[m] of the upper electrode Zu[m] in the discharging section D[m] specified as the inspected discharging section DK3 is maintained at the reference potential VC2.

As indicated in FIG. 12, when, in the unit inspection period TK[j], the individual specification signal Sd[m] indicates the value 4 by which the discharging section D[m] is specified as the non-target to-be-inspected discharging section DK0 the coupling state specification circuit 34 keeps the coupling state specification signal Qc[m] high in the unit inspection period TK[j]. In this case, the switch Wc[m] is turned on in the unit inspection period TK[j]. In the unit inspection period TK[j], therefore, a driving signal Com is supplied from the line Lc through the switch Wc[m] to the upper electrode Zu[m] in the discharging section D[m] specified as the non-target to-be-inspected discharging section DK0. In the control period TK2[j], therefore, the potential VZ[m] of the upper electrode Zu[m] in the discharging section D[m] specified as the non-target to-be-inspected discharging section DK0 is maintained at the reference potential VC2.

FIG. 10 exemplifies a case in which the discharging section D[1] is specified as the inspection-in-progress discharging section DK2 in the unit inspection period TK[1], the discharging section D[2] is specified as the inspection-in-progress discharging section DK2 in the unit inspection period TK[2], and the discharging section D[3] is specified as the non-target to-be-inspected discharging section DK0 in the inspection preparation period TTM and inspection periods TTK.

That is, FIG. 10 assumes a case in which the discharging section D[1] is specified as the to-be-inspected discharging section DK in the inspection preparation period TTM, as the inspection-in-progress discharging section DK2 in the unit inspection period TK[1], and as the inspected discharging section DK3 in the unit inspection periods TK[2] to TK[j]. FIG. 10 also assumes a case in which the discharging section D[2] is specified as the to-be-inspected discharging section DK in the inspection preparation period TTM, as the planned-to-be-inspected discharging section DK1 in the unit inspection period TK[1], as the inspection-in-progress discharging section DK2 in the unit inspection period TK[2], and as the inspected discharging section DK3 in the unit inspection periods TK[3] to TK[j]. In FIG. 10, J is assumed to be a natural number equal to or greater than 3.

Figure 13:
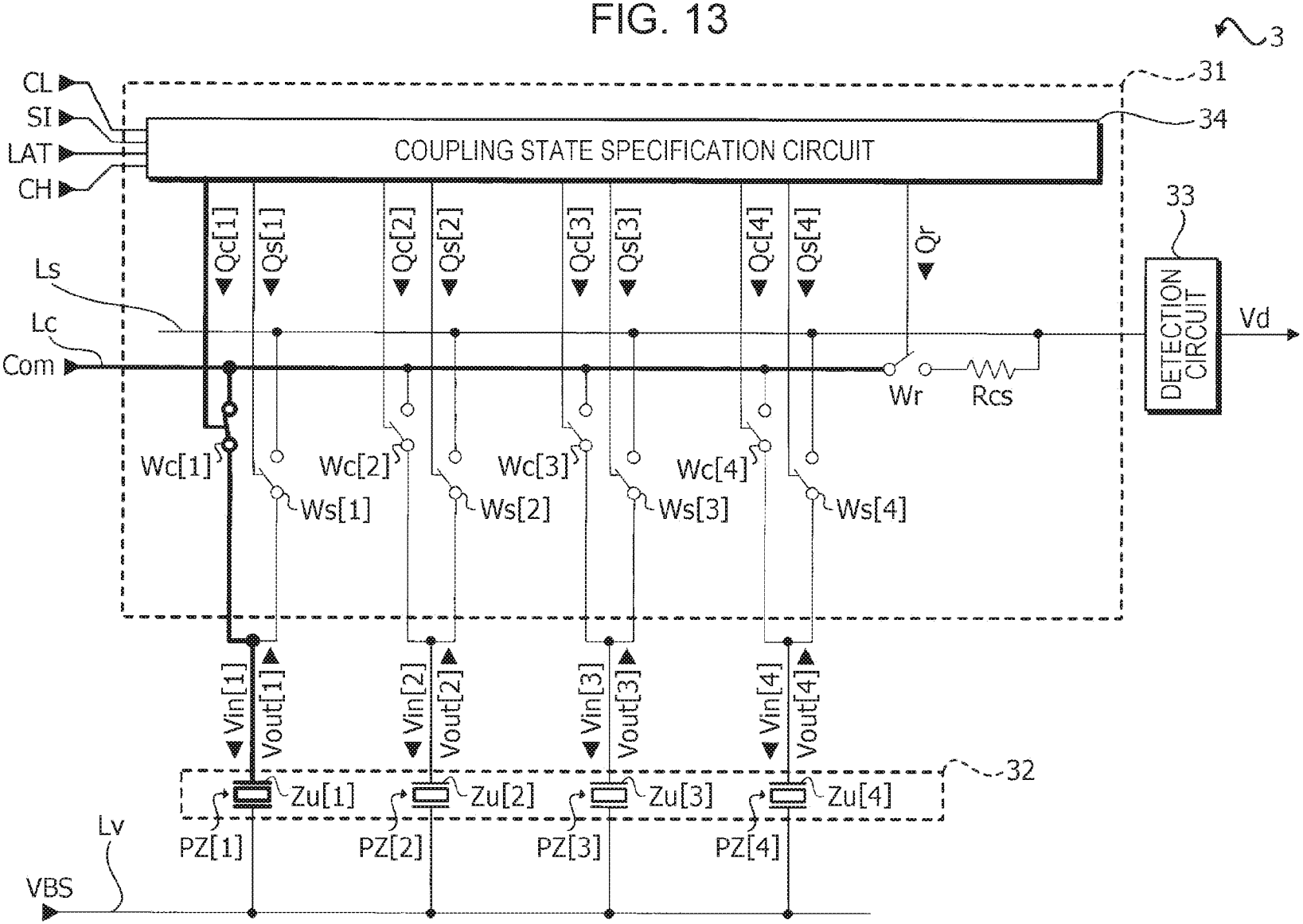
FIG. 13 illustrates an example of the operation of the head unit.

FIG. 13 illustrates how a driving signal Com is supplied to the upper electrode Zu[m] of the piezoelectric element PZ[m] disposed in the discharging section D[m] through the switch Wc[m]. In FIG. 13, the potential VZ[m] of the upper electrode Zu[m] disposed in the discharging section D[m] changes by following a change in the potential of the driving signal Com. FIG. 13 exemplifies a case in which m is 1.

As described above, a driving signal Com is supplied through the switch Wc[m] to each discharging section D in the unit preparation period TM1, to the non-target to-be-inspected discharging section DK0 in the unit preparation period TM2, to the inspected discharging sections DK3 and non-target to-be-inspected discharging section DK0 in the control period TK1[j], and to the inspection-in-progress discharging section DK2, inspected discharging sections DK3, and non-target to-be-inspected discharging section DK0 in the control period TK2[j]. In the supply of a driving signal Com to each of the above discharging sections D, there is a match between the potential of the driving signal Com and the potential VZ[m] of the upper electrode Zu[m] disposed in the discharging section D[m] when the switch Wc[m] switches from the off state to the on state. Therefore, even when the above supply of a driving signal Com to the piezoelectric element PZ[m] starts, the potential VZ[m] of the upper electrode Zu[m] does not change abruptly.

Figure 14:
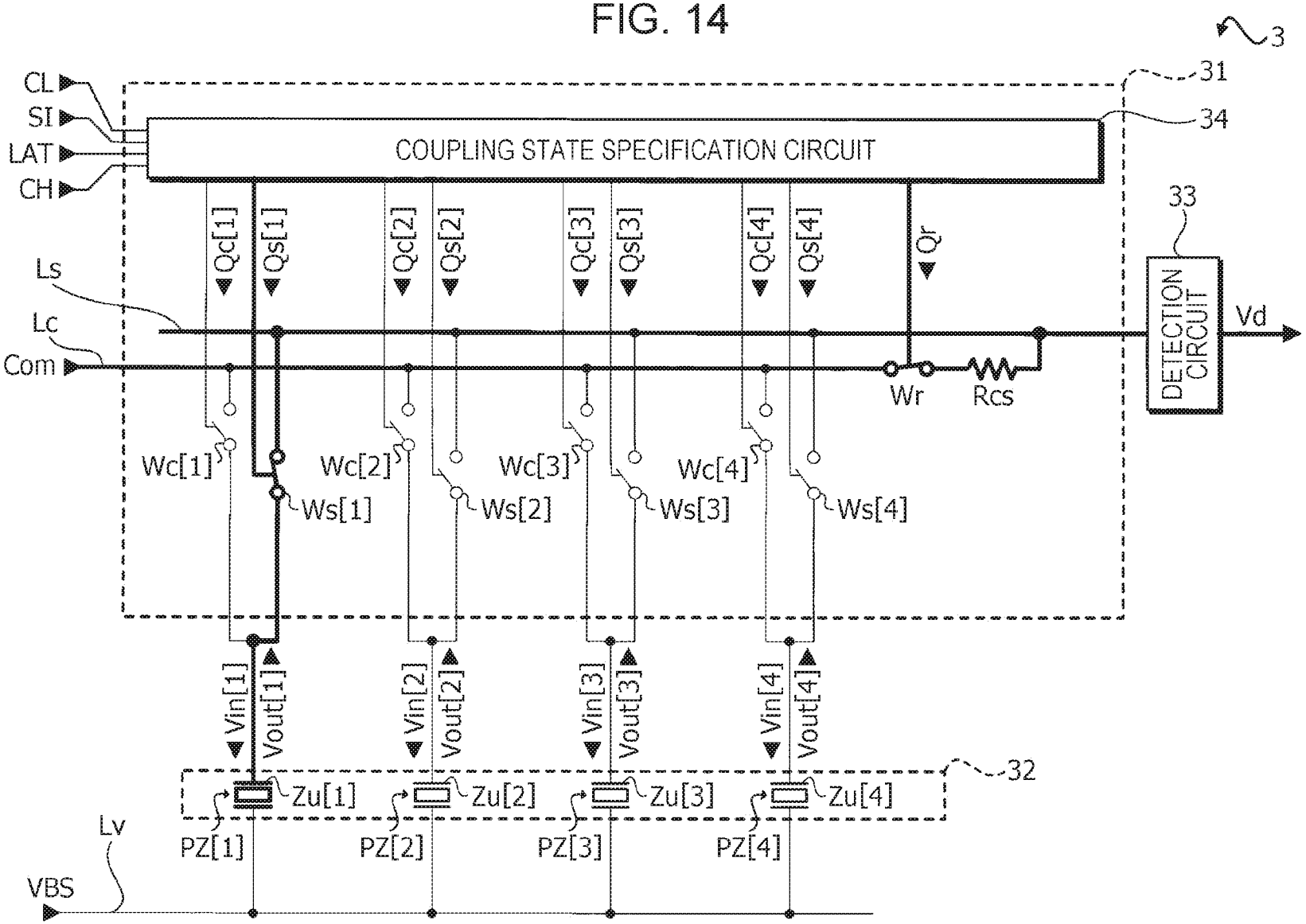
FIG. 14 illustrates an example of the operation of the head unit.

FIG. 14 illustrates how a driving signal Com is supplied to the upper electrode Zu[m] of the piezoelectric element PZ[m] disposed in the discharging section D[m] through the switch Wr and switch Ws[m]. FIG. 14 exemplifies a case in which m is 1.

As described above, a driving signal Com is supplied through the switch Wr and switch Ws[m] to the inspection-in-progress discharging section DK2 in the control period TK1[j]. When the discharging section D[m] is specified as the inspection-in-progress discharging section DK2 in the control period TK1[j], the potential VZ[m] of the upper electrode Zu[m] at the start of the control period TK1[j] is the reference potential VC1 and the potential of the driving signal Com at the start of the control period TK1[j] is the reference potential VC2. Therefore, when the supply of a driving signal Com to the piezoelectric element PZ[m] starts through the switch Wc[m] at the start of the unit inspection period TK1[j], the potential VZ[m] of the upper electrode Zu[m] changes abruptly. This may cause a problem in the piezoelectric element PZ[m].

In this embodiment, however, a driving signal Com is supplied to the upper electrode Zu[m] of the piezoelectric element PZ[m] disposed in the discharging section D[m] specified as the inspection-in-progress discharging section DK2 in the control period TK1[j] through the switch Wr, switch Ws[m], and resistor Rcs as illustrated in FIG. 14. In this embodiment, therefore, it is possible to mitigate a change in the potential VZ[m] of the upper electrode Zu[m], the change being caused when the supply of a driving signal Com to the upper electrode Zu[m] starts, when compared with an aspect in which a driving signal Com is supplied to the piezoelectric element PZ[m] through the switch Wc[m]. Therefore, this embodiment can reduce the possibility that a problem occurs in the piezoelectric element PZ[m], when compared with the aspect in which a driving signal Com is supplied to the piezoelectric element PZ[m] through the switch Wc[m].

As described above, the detection circuit 33 creates a vibration waveform signal Vd[m] according to a detected potential signal Vout[m]. Specifically, the detection circuit 33 amplifies a detected potential signal Vout[m] and removes its noise component and direct-current component so as to create a vibration waveform signal Vd[m] shaped to a waveform suitable to processing in the inspecting unit 6. That is, in this embodiment, the vibration waveform signal Vd[m] exhibits the waveform of vibration caused in the discharging section D[m] specified as the inspection-in-progress discharging section DK2 in the control period TK1[j].

5. INSPECTION UNIT

Vibration caused in the discharging section D will now be described, after which the inspecting unit 6 will be described.

In general, vibration caused in the discharging section D has a natural vibration cycle determined by the shapes and sizes of the nozzle N and cavity 322, the weight of ink supplied in the cavity 322, and the like. When, for example, there is a discharging failure due to bubbles included in the cavity 322 in the discharging section D, the cycle of vibration caused in the discharging section D generally becomes shorter than when the discharging state is normal. Conversely, when there is a discharging failure due to foreign matter such as paper powder adhering to the vicinity of the nozzle N in the discharging section D, the cycle of vibration caused in the discharging section D generally becomes longer than when the discharging state is normal. The cycle NTc of vibration caused in the discharging section D varies in this way, depending on the discharging state of the ink in the discharging section D. Therefore, according to the cycle NTc of vibration caused in the discharging section D, the discharging state of the ink in the discharging section D can be inspected.

As described above, the vibration waveform signal Vd[m] exhibits the waveform of vibration caused in the discharging section D[m] driven as the to-be-inspected discharging section DK. That is, the vibration waveform signal Vd[m] has the cycle NTc. This makes it possible to inspect the discharging state of the ink in the discharging section D[m] according to the cycle NTc of the vibration waveform signal Vd[m].

Figures 15, 16:
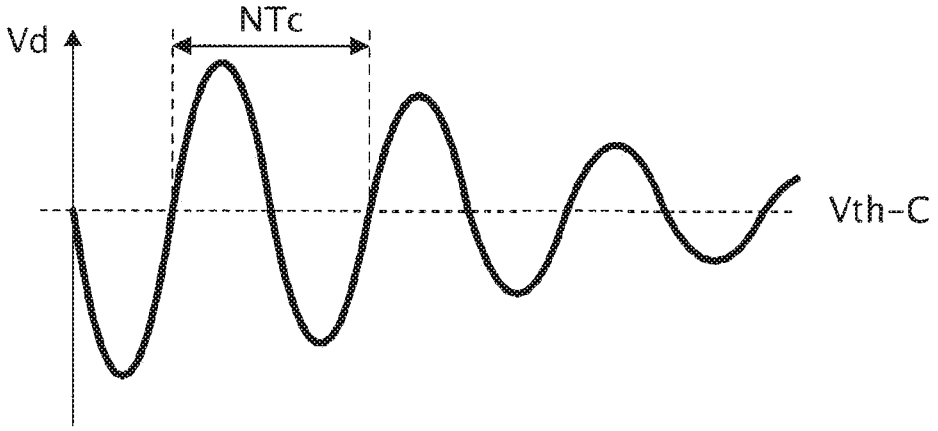
FIG. 15 illustrates an example of a vibration waveform signal.
FIG. 16 indicates an example of discharging state information.

The inspecting unit 6 compares the vibration waveform signal Vd[m] and a potential Vth-c at the center of the amplitude of the vibration waveform signal Vd[m], as illustrated in FIG. 15. The inspecting unit 6 then identifies the cycle NTc of the vibration waveform signal Vd[m] according to the result of the comparison.

The inspecting unit 6 also compares the cycle NTc and at least one of a threshold Tth1 and a threshold Tth2 as indicated in FIG. 16 to decide the discharging state of the ink in the discharging section D[m] driven as the to-be-inspected discharging section DK, after which the inspecting unit 6 creates discharging state information NVT. The threshold Tth1 is a value indicating a boundary between the cycle NTc of vibration caused in the discharging section D when the discharging state of the discharging section D is normal and the cycle NTc of vibration caused in the discharging section D when bubbles are present in the cavity 322 in the discharging section D. The threshold Tth2, which is larger than the threshold Tthl, is a value indicating a boundary between the cycle NTc of vibration caused in the discharging section D when the discharging state of the discharging section D is normal and the cycle NTc of vibration caused in the discharging section D when foreign matter adheres to the vicinity of the nozzle N in the discharging section D. When the cycle NTc is at least the threshold Tth1 and at most the threshold Tth2, the inspecting unit 6 decides that the discharging state of the ink in the discharging section D is normal. In this case, the inspecting unit 6 sets 1, which indicates that the discharging state of the to-be-inspected discharging section DK is normal, in the discharging state information NVT. When the cycle NTc is smaller than the threshold Tthl, the inspecting unit 6 decides that the to-be-inspected discharging section DK has a discharging failure due to bubbles. In this case, the inspecting unit 6 sets 2, which indicates that the to-be-inspected discharging section DK has a discharging failure due to bubbles, in the discharging state information NVT. When the cycle NTc is larger than the threshold Tth2, the inspecting unit 6 decides that the to-be-inspected discharging section DK has a discharging failure due to the adhesion of foreign matter. In this case, the inspecting unit 6 sets 3, which indicates that the to-be-inspected discharging section DK has a discharging failure due to the adhesion of foreign matter, in the discharging state information NVT.

6. RELATIONSHIP BETWEEN DISCHARGING STATE INSPECTION PROCESSING AND MICRO-VIBRATION PROCESSING

Figure 17:
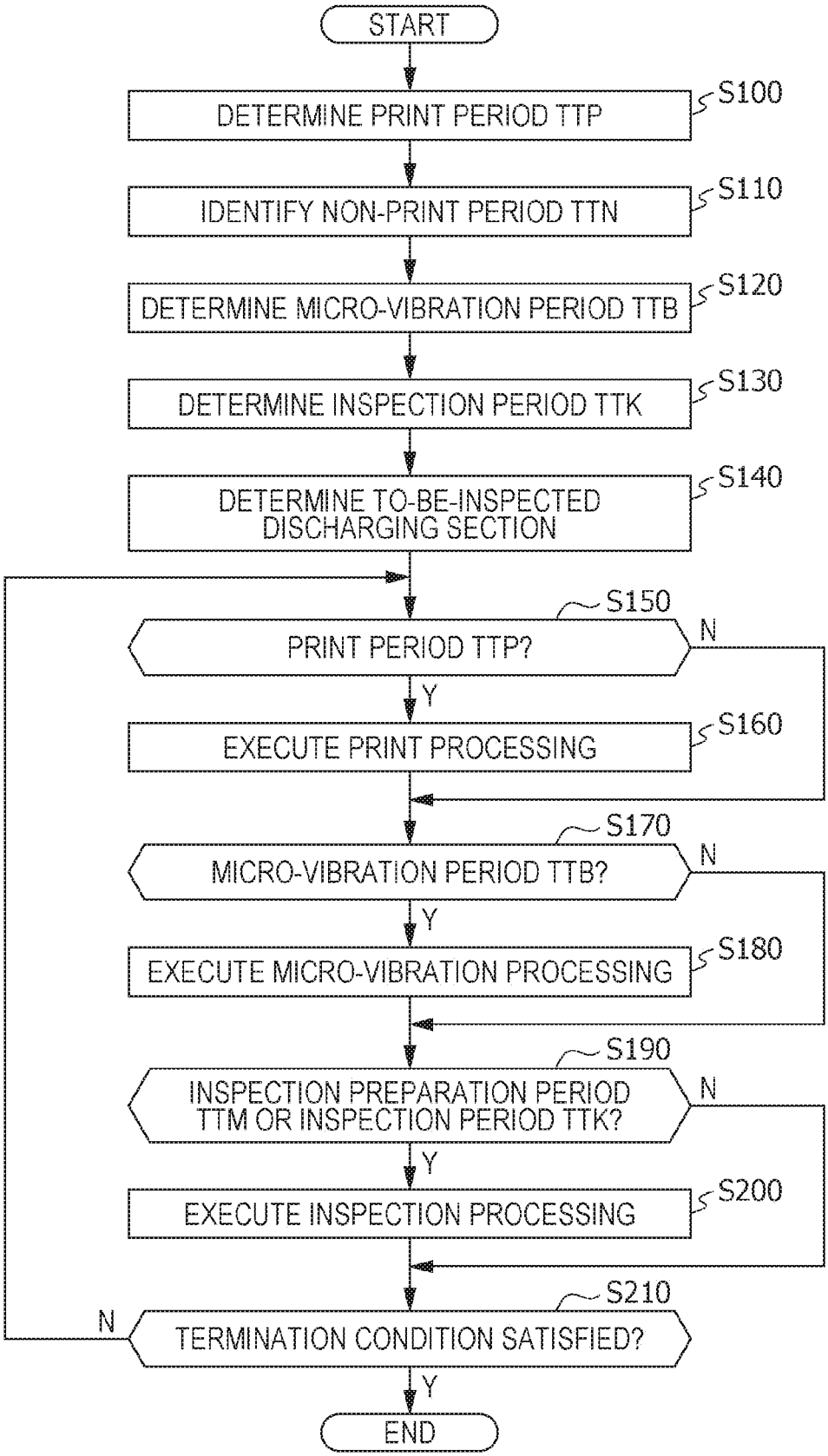
FIG. 17 is a flowchart illustrating an example of the operation of the ink jet printer.
Figure 18:
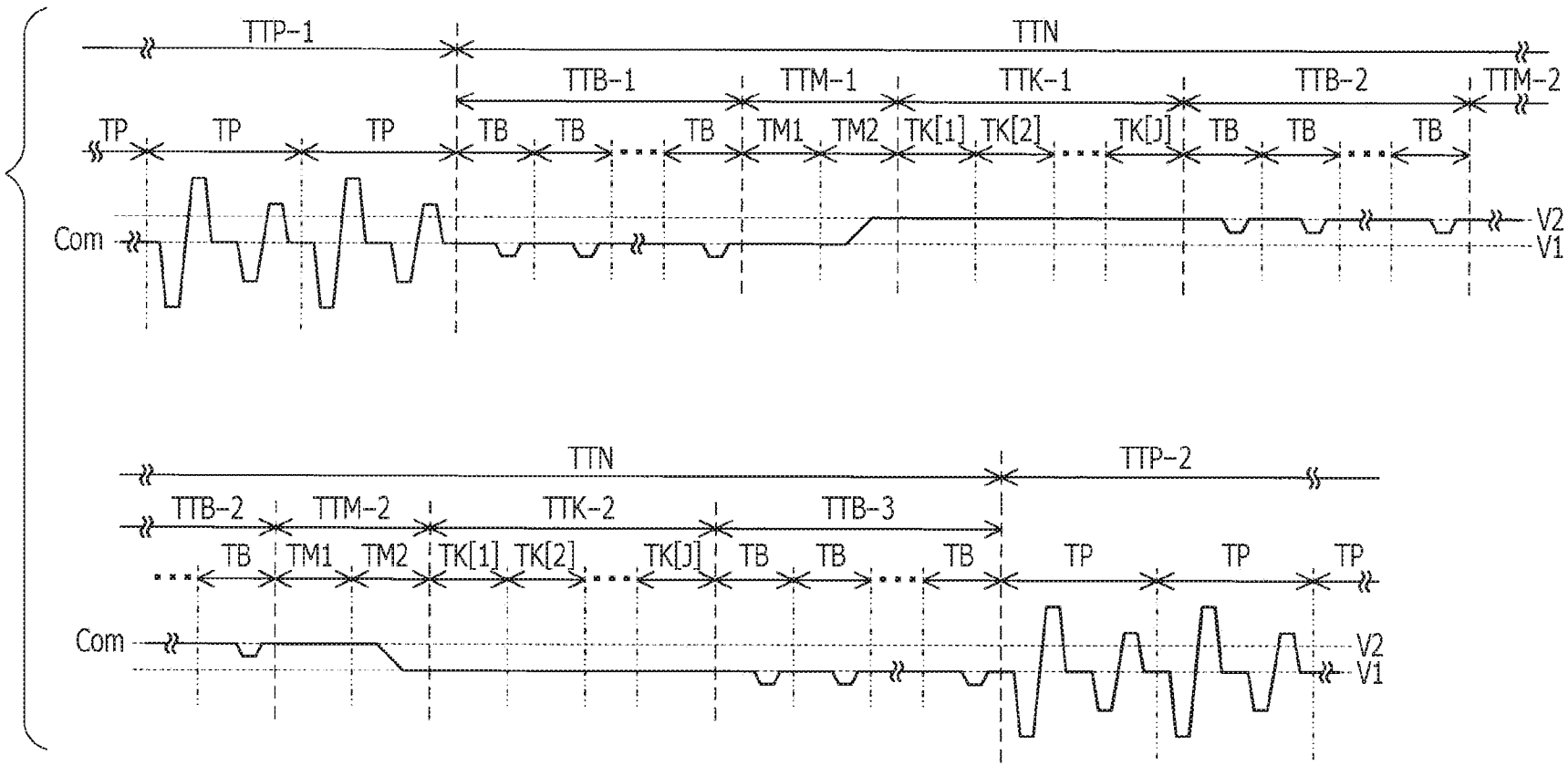
FIG. 18 is a timing diagram illustrating an example of the operation of the ink jet printer.

A relationship among print processing, discharging state inspection processing, and micro-vibration processing will now be described with reference to FIGS. 17 and 18. FIG. 17 is a flowchart illustrating the operation of the ink jet printer 1 after it has been started. FIG. 18 illustrates operation periods of the ink jet printer 1 after it has been started.

As illustrated in FIG. 17, when the ink jet printer 1 receives print data Img from the host computer, the control unit 2 determines a print period TTP during which print processing based on the print data Img is executed, according to the print data Img (S100). In this embodiment, it will be assumed that the print data Img indicates that a plurality of images are to be formed on recording paper P. Therefore, the control unit 2 sets a plurality of print periods TTP in one-to-one correspondence with the plurality of images indicated in the print data Img in step S100. FIG. 18 exemplifies a case in which the control unit 2 has set a plurality of print periods TTP including a print period TTP-1 and a print period TTP-2.

Next, the control unit 2 identifies a period, in the operation period of the ink jet printer 1, other than the print periods TTP as a non-print period TTN (S110). FIG. 18 exemplifies a case in which the control unit 2 has identified a period between the print period TTP-1 and the print period TTP-2 as the non-print period TTN.

Next, the control unit 2 sets one or a plurality of micro-vibration periods TTB in the non-print period TTN (S120). FIG. 18 exemplifies a case in which the control unit 2 has set three micro-vibration periods TTB, TTB-1, TTB-2 and TTB-3, in the non-print period TTN.

Next, the control unit 2 sets inspection preparation periods TTM and inspection periods TTK in periods, in the non-print period TTN, other than the micro-vibration periods TTB (S130). FIG. 18 exemplifies a case in which the control unit 2 has set an inspection preparation period TTM-1 and an inspection period TTK-1 between the micro-vibration period TTB-1 and the micro-vibration period TTB-2 and also has set an inspection preparation period TTM-2 and an inspection period TTK-2 between the micro-vibration period TTB-2 and the micro-vibration period TTB-3.

Referring again to FIG. 17, the control unit 2 determines a to-be-inspected discharging section DK eligible for the inspection of the discharging state in the inspection period TTK (S140).

Specifically, according to the length in time of the inspection period TTK determined in step S130, the control unit 2 first identifies the number of discharging sections D that can be inspected in the inspection period TTK in step S140. Specifically, the control unit 2 may identify the number of unit inspection periods TK that can be included in the inspection period TTK, for example.

Next, in step S140, the control unit 2 determines a to-be-inspected discharging section DK eligible for the inspection of the discharging state in the inspection period TTK determined in step S130, according to one or both of an inspection history for previous ink discharging from the discharging sections D[1] to D[M] and a history of previous ink discharging in the discharging sections D[1] to D[M]. Specifically, as a to-be-inspected discharging section DK, the control unit 2 may select, for example, a discharging section D[m] for which an elapsed time from a previous discharging state inspection is relative long, from the discharging sections D[1] to D[M]. Alternatively, as a to-be-inspected discharging section DK, the control unit 2 may select, for example, a discharging section D[m] for which an elapsed time from previous ink discharging is relative long, from the discharging sections D[1] to D[M]. Alternatively, as a to-be-inspected discharging section DK, the control unit 2 may select a discharging section D[m] for which the number of times ink was discharged in a particular period is relative large, from the discharging sections D[1] to D[M].

The control unit 2 then decides whether the current time is in a print period TTP or whether a print period TTP will come within a predetermined time from the current time, as illustrated in FIG. 17 (step S150). When the decision in step S150 is affirmative, the control unit 2 executes print processing (S160). When the decision in step S150 is negative, the control unit 2 causes processing to proceed to step S170.

The control unit 2 also decides whether the current time is in a micro-vibration period TTB or whether a micro-vibration period TTB will come within a predetermined time from the current time (step S170). When the decision in step S170 is affirmative, the control unit 2 executes micro-vibration processing (S180). When the decision in step S170 is negative, the control unit 2 causes processing to proceed to step S190.

The control unit 2 also decides whether the current time is in an inspection preparation period TTM or inspection period TTK or whether an inspection preparation period TTM will come within a predetermined time from the current time (step S190). When the decision in step S190 is affirmative, the control unit 2 executes discharging state inspection processing (S200). When the decision in step S190 is negative, the control unit 2 causes processing to proceed to step S210.

The control unit 2 then decides whether a predetermined termination condition has been satisfied (S210). When the decision in step S210 is affirmative, the control unit 2 terminates a series of processing illustrated in FIG. 17. When the decision in step S210 is negative, the control unit 2 causes processing to return to step S150. The predetermined termination condition may be, for example, that all periods set in steps S100 to S130 have been terminated or that the ink jet printer 1 has been powered off.

In this embodiment, when a plurality of micro-vibration periods TTB are set in the non-print period TTN, there is a difference between the potential of the driving signal Com at the start and end of one micro-vibration period TTB of the plurality of micro-vibration periods TTB and the potential of the driving signal Com at the start and end of another micro-vibration period TTB of the plurality of micro-vibration periods TTB, the other micro-vibration period TTB following the one micro-vibration period TTB. In the example in FIG. 18, for example, the potential of the driving signal Com at the start and end of the micro-vibration period TTB-1 is the reference potential V1, the potential of the driving signal Com at the start and end of the micro-vibration period TTB-2 is the reference potential V2, and the potential of the driving signal Com at the start and end of the micro-vibration period TTB-3 is the reference potential V1.

The driving signal Com in an inspection preparation period TTM between one micro-vibration period TTB and another micro-vibration period TTB has a waveform the potential of which changes from the reference potential VC1, which is the potential of the driving signal Com at the termination of the one micro-vibration period TTB, to the reference potential VC2, which is the potential of the driving signal Com at the start of the other micro-vibration period TTB. The driving signal Com in an inspection period TTK between the one micro-vibration period TTB and the other micro-vibration period TTB is maintained at the reference potential VC2, which is the potential of the driving signal Com at the start of the other micro-vibration period TTB. In the example in FIG. 18, for example, the driving signal Com in the inspection preparation period TTM-1 has a waveform the potential of which changes from the reference potential V1 to the reference potential V2, the driving signal Com in the inspection period TTK-1 has a waveform maintained at the reference potential V2, the driving signal Com in the inspection preparation period TTM-2 has a waveform the potential of which changes from the reference potential V2 to the reference potential V1, and the driving signal Com in the inspection period TTK-2 has a waveform maintained at the reference potential V1.

In this embodiment, to execute discharging state inspection processing for a to-be-inspected discharging section DK, a difference in the potential of the driving signal Com at the start and end of an inspection preparation period TTM is used to cause vibration in the to-be-inspected discharging section DK. In other words, in this embodiment, discharging state inspection processing in an inspection period TTK between one micro-vibration period TTB and another micro-vibration period TTB is executed by using a difference in potential between the reference potential VC1, which is the potential of the driving signal Com at the termination of the one micro-vibration period TTB, and the reference potential VC2, which is the potential of the driving signal Com at the start of the other micro-vibration period TTB.

In this embodiment, different to-be-inspected discharging sections DK may be used as a to-be-inspected discharging section DK eligible for the inspection of the discharging state in the inspection period TTK-1 and a to-be-inspected discharging section DK eligible for the inspection of the discharging state in the inspection period TTK-2. When, for example, the discharging sections D[1] and D[2] are intended to be inspected in the inspection period TTK-1, the discharging section D[3] may be intended to be inspected in the inspection period TTK-2.

7. REFERENCE EXAMPLE

Figure 19:
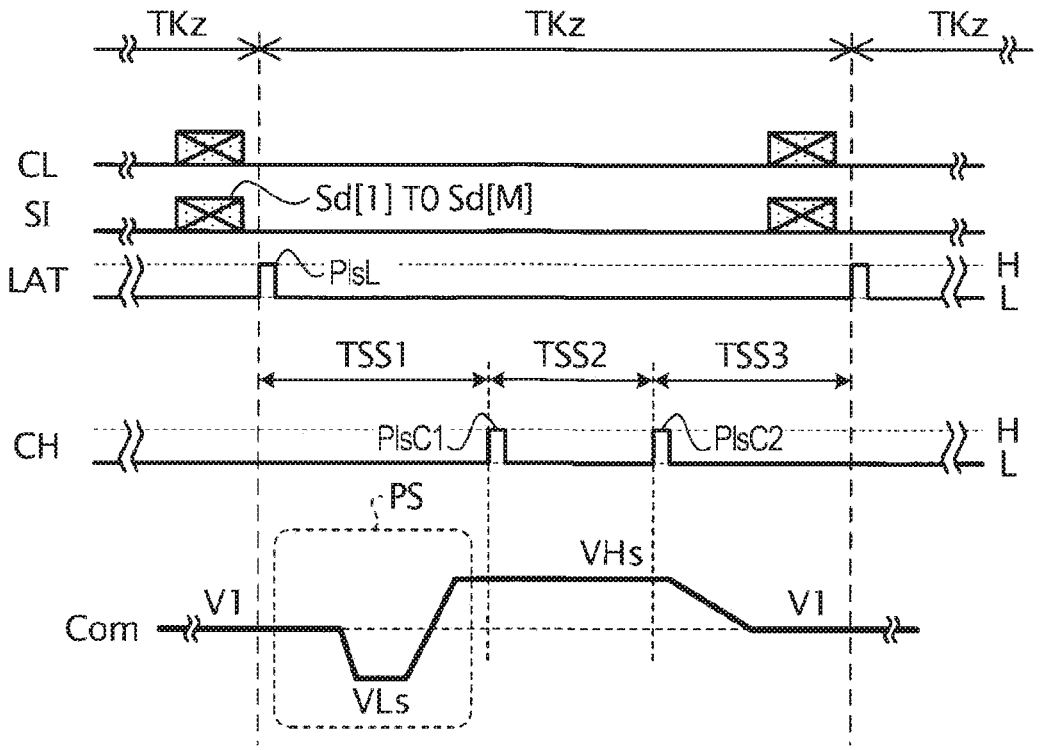
FIG. 19 is a timing diagram illustrating an example of the operation of an ink jet printer in a reference example.

To more clarify the effect of this embodiment, discharging state inspection processing in a reference example will be described below with reference to FIGS. 19 and 20. FIG. 19 is a timing diagram illustrating the waveform of the driving signal Com output from the driving signal creating unit 4 when discharging state inspection processing in the reference example is executed. FIG. 20 indicates a relationship among the individual specification signal Sd[m] output from the control unit 2 and the coupling state specification signals Qc[m] and Qs[m] output from the coupling state specification circuit 34.

An ink jet printer in the reference example has a structure similar to the structure of the ink jet printer 1 illustrated in FIGS. 1 to 5. In the ink jet printer in the reference example, the coupling state specification signal Qr is kept low and the switch Wr is kept turned off.

In the execution of discharging state inspection processing in the reference example, one or a plurality of unit inspection periods TKz are set as illustrated in FIG. 19. The driving signal Com in the reference example has a waveform PS the potential of which changes from the reference potential V1 to a potential VLs, which is lower than the reference potential V1, in a control period TSS1 in a unit inspection period TKz and then changes to a potential VHs, which is higher than the reference potential V1. The driving signal Com in the reference example is maintained at the potential VHs in a control period TSS2 in the unit inspection period TKz, the control period TSS2 following the control period TSS1, after which the potential of the driving signal Com changes from the potential VHs to the reference potential V1 in a control period TSS3 that follows the control period TSS2.

In the reference example, it will be assumed that, in the unit inspection period TKz, the individual specification signal Sd[m] can take any one of the following two values: a value of 1 that specifies a discharging section D[m] as a to-be-inspected discharging section DK eligible for discharging state inspection processing, and a value of 2 that specifies the discharging section D[m] as a non-target to-be-inspected discharging section DK0 not eligible for discharging state inspection processing, as illustrated in FIG. 20.

When the individual specification signal Sd[m] indicates the value 1 that specifies the discharging section D[m] as a to-be-inspected discharging section DK in a unit inspection period TKz, the coupling state specification circuit 34 keeps the coupling state specification signal Qc[m] high in the control periods TSS1 and TSS3 and keeps the coupling state specification signal Qs[m] high in the control period TSS2, as illustrated in FIG. 20. In this case, the switch Wc[m] is turned on in the control period TSS1 and a driving signal Com having the waveform PS is supplied to the upper electrode Zu[m] in the discharging section D[m], so the discharging section D[m] is driven, causing vibration in the discharging section D[m]. After that, the switch Ws[m] is turned on in the control period TSS2 and the detection circuit 33 detects vibration remaining in the upper electrode Zu[m] in the discharging section D[m] as a detected potential signal Vout[m]. The switch Wc[m] is then turned on in the control period TSS3 and a driving signal Com the potential of which changes from the potential VHs to the reference potential V1 is supplied to the upper electrode Zu[m] in the discharging section D[m]. The potential VZ[m] of the upper electrode Zu[m] is changed from the potential VHs back to the reference potential V1 accordingly.

As described above, to drive a to-be-inspected discharging section DK in the reference example, it is necessary to change the potential of the driving signal Com, for example, from the reference potential V1 to the potential VLs to the potential VHs and back to the reference potential V1 in each unit inspection period TKz.

In this embodiment, however, the driving signal Com the potential of which is maintained at the reference potential VC2 is supplied to the upper electrode Zu[m], in the to-be-inspected discharging section DK, set to the reference potential VC1 in the unit inspection period TK so that vibration is caused in the to-be-inspected discharging section DK.

In this embodiment, therefore, control in the creation of a driving signal Com is easier than in the reference example. Also, in this embodiment, the amount of electric power involved in the creation of a driving signal Com can be made smaller than in the reference example. Also, in this embodiment, a time taken to vibrate a to-be-inspected discharging section DK by the use of a driving signal Com can be made shorter than in the reference example.

8. CONCLUSION OF THIS EMBODIMENT

This embodiment will be compiled below together with its effect.

A head unit 3 in this embodiment has: a line Lc through which a driving signal Com is supplied; a discharging section D[1] that has a piezoelectric element PZ[1] having a pair of electrodes including an upper electrode Zu[1], the discharging section D[1] discharging ink according to the displacement of the piezoelectric element PZ[1], the displacement being caused when the driving signal Com is supplied to the upper electrode Zu[1]; a detection circuit 33 that detects the potential of a line Ls; a switch Wc[1] that makes a switchover as to whether to electrically couple the upper electrode Zu[1] and line Lc together; a switch Ws[1] that makes a switchover as to whether to electrically couple the upper electrode Zu[1] and line Ls together; a switch Wr that makes a switchover as to whether to electrically couple the line Lc and line Ls together; and a resistor Rcs provided in series with the switch Wr between the line Lc and the line Ls.

In this embodiment, the line Lc is an example of a first line, the line Ls is an example of a second line, the discharging section D[1] is an example of a first discharging section, the piezoelectric element PZ[1] is an example of a first piezoelectric element, the upper electrode Zu[1] is an example of a first electrode, the switch Wc[1] is an example of a first switch, the switch Ws[1] is an example of a second switch, the switch Wr is an example of a third switch, and the Rcs is an example of a first resistor.

In this embodiment, when the switch Wc[1] is turned on, a driving signal Com can be supplied to the upper electrode Zu[1]. In this embodiment, therefore, ink can be discharged from the discharging section D[1] by driving the discharging section D[1] with the driving signal Com.

In this embodiment, when, with the switch Wc[1] and switch Wr turned off, the potential of the driving signal Com is set to other than the potential of the upper electrode Zu[1] and then the switch Ws[1] and switch Wr are turned on, a driving signal Com is supplied from the line Lc through the switch Wr, resistor Rcs, and switch Ws[1] to the upper electrode Zu[1]. In this case, the potential of the upper electrode Zu[1] changes from a potential different from the potential of the driving signal Com to the potential of the driving signal Com. As a result, the piezoelectric element PZ[1] vibrates. When the detection circuit 33 detects a change in the potential of the upper electrode Zu[1], the change matching the vibration of the piezoelectric element PZ[1], through the switch Ws[1] and line Ls, the discharging state of the ink in the discharging section D[1] can be inspected according to the result of detection by the detection circuit 33. That is, in the inspection of the discharging state of the ink in the discharging section D[1] in this embodiment, it is only necessary to set the potential of the driving signal Com to other than the potential of the upper electrode Zu[1]. In this embodiment, therefore, it is possible to simplify the waveform of the driving signal Com supplied to the line Lc in the inspection of the discharging state, when compared with the previous aspect in which, in the inspection of the discharging state of the ink in the discharging section D[1], the potential of the driving signal Com is changed with the switch Wc[1] turned on to vibrate the piezoelectric element PZ[1]. In this embodiment, therefore, it is possible to simplify control in the creation of a driving signal Com used in the inspection of the discharging state and to shorten a time taken to cause vibration in the piezoelectric element PZ[1] by the use of a driving signal Com to inspect the discharging state, when compared with the previous aspect.

In this embodiment, the resistor Rcs is provided between the line Lc and the line Ls. In this embodiment, therefore, when a driving signal Com is supplied from the line Lc through the switch Wr, resistor Rcs, and switch Ws[1] to the upper electrode Zu[1], for example, a change in the potential of the upper electrode Zu[1] can be mitigated, when compared with an aspect in which a driving signal Com is supplied from the line Lc through the switch Wc[1] to the upper electrode Zu[1]. When a driving signal Com having a potential different from the potential of the upper electrode Zu[1] is supplied to the piezoelectric element PZ[1], therefore, this embodiment makes it is possible to suppress a problem caused in the piezoelectric element PZ[1] due to a change in the potential of the upper electrode Zu[1], the change being caused by the supply of the driving signal Com, when compared with the aspect in which a driving signal Com is supplied from the line Lc through the switch Wc[1] to the upper electrode Zu[1]. That is, this embodiment makes it possible to safely supply, to the upper electrode Zu[1], a driving signal Com with a potential different from the potential of the upper electrode Zu[1]. In other words, this embodiment makes it possible both to reduce a control load involved in the creation of a driving signal Com as a result of simplifying the potential of the driving signal Com and to reduce the possibility that a problem occurs in the piezoelectric element PZ[1].

In this embodiment: the switch Wc[1] is turned on in a unit preparation period TM1, is turned off in a unit preparation period TM2 following the termination of the unit preparation period TM1, and is turned off in a control period TK1[1] following the termination of the unit preparation period TM2; the switch Ws[1] is turned off in the unit preparation period TM1 and unit preparation period TM2 and is turned on in the control period TK1[1]; the switch Wr is turned off in the unit preparation period TM1 and unit preparation period TM2 and is turned on in the control period TK1[1]; the potential of the driving signal Com is set to a reference potential VC1 in unit preparation period TM1, changes from the reference potential VC1 to a reference potential VC2 in the unit preparation period TM2, and is maintained at the reference potential VC2 in the control period TK1[1]; and the detection circuit 33 detects the potential of the line Ls in the control period TK1[1].

In this embodiment, the unit preparation period TM1 is an example of a first period, the unit preparation period TM2 is an example of a second period, the control period TK1[1] is an example of a third period, the reference potential VC1 is an example of a first potential, and the reference potential VC2 is an example of a second potential.

In this embodiment, in the unit preparation period TM1, the potential of the upper electrode Zu[1] is set to the reference potential VC1, and in the control period TK1[1], the potential of the upper electrode Zu[1] changes from the reference potential VC1 to the reference potential VC2. In this embodiment, therefore, the piezoelectric element PZ[1] vibrates in the control period TK1[1]. Therefore, this embodiment makes it is possible for the detection circuit 33 to inspect the discharging state of the ink in the discharging section D[1] in the control period TK1[1] according to the potential of the upper electrode Zu[1], the potential being detected through the line Ls and switch Ws[1].

In this embodiment, the switch Wc[1] is turned on in a control period TK2[1] following the termination of the control period TK1[1], the switch Ws[1] is turned off in the control period TK2[1], the switch Wr is turned off in the control period TK2[1], and the potential of the driving signal Com is maintained at the reference potential VC2 in the control period TK2[1].

In this embodiment, the potential of the upper electrode Zu[1] can be maintained at the reference potential VC2 over a duration from the control period TK1[1] to the control period TK2[1]. In this embodiment, therefore, after the detection circuit 33 has detected the potential of the upper electrode Zu[1] in the control period TK1[1], vibration caused in the discharging section D[1] can be damped.

The head unit 3 in this embodiment has: a discharging section D[2] that has a piezoelectric element PZ[2] having a pair of electrodes including an upper electrode Zu[2], the discharging section D[2] discharging ink according to the displacement of the piezoelectric element PZ[2], the displacement being caused when the driving signal Com is supplied to the upper electrode Zu[2]; a switch Wc[2] that makes a switchover as to whether to electrically couple the upper electrode Zu[2] and line Lc together; and a switch Ws[2] that makes a switchover as to whether to electrically couple the upper electrode Zu[2] and line Ls together. The switch Wc[2] is turned on in the unit preparation period TM1 and is turned off in the unit preparation period TM2, control period TK1[1], and control period TK2[1]. The switch Ws[2] is turned off in the unit preparation period TM1, unit preparation period TM2, control period TK1[1], and control period TK2[1].

In this embodiment, the discharging section D[2] is an example of a second discharging section, the piezoelectric element PZ[2] is an example of a second piezoelectric element, the upper electrode Zu[2] is an example of a second electrode, the switch Wc[2] is an example of a fourth switch, and the switch Ws[2] is an example of a fifth switch.

In this embodiment, the potential of the upper electrode Zu[2] is set to the reference potential VC1 in the unit preparation period TM1, after which the potential is maintained at the reference potential VC1 until the control period TK2[1]. Therefore, when a driving signal Com set to the reference potential VC2 is supplied to the upper electrode Zu[2] in a period following the control period TK2[1], the piezoelectric element PZ[2] can be quickly vibrated and the discharging state of the ink in the discharging section D[2] can be inspected.

In this embodiment, the switch Wc[1] is turned on in a control period TK1[2] following the termination of the control period TK2[1], the switch Ws[1] is turned off in the control period TK1[2], the switch Wr is turned on in the control period TK1[2], the switch Wc[2] is turned off in the control period TK1[2], the switch Ws[2] is turned on in the control period TK1[2], and the potential of the driving signal Com is maintained at the reference potential VC2 in the control period TK1[2].

In this embodiment, the control period TK1[2] is an example of a fifth period.

In this embodiment, a driving signal Com set to the reference potential VC2 is supplied to the upper electrode Zu[2] set to the reference potential VC1 through the switch Wr, resistor Rcs, and switch Ws[2] in the control period TK1[2]. The discharging state of the ink in the discharging section D[2] can be inspected by vibrating the piezoelectric element PZ[2].

B. Variations

The embodiment described above can be modified in various ways. Aspects of specific modifications will be exemplified below. Any two or more aspects selected from the exemplary examples described below can be appropriately combined within a range in which any mutual contradiction does not occur. In the variations exemplified below, elements having effects and functions similar to those in the embodiment above will be denoted by the relevant reference numerals used in the embodiment above and detailed descriptions of these elements will be appropriately omitted.

First Variation

Although, in the embodiment described above, the ink jet printer 1 has executed micro-vibration processing, in a unit micro-vibration period TB, in which the discharging section D is driven to the extent that ink is not discharged from the discharging section D, the present disclosure is not limited to this aspect. For example, the ink jet printer 1 may execute flushing processing, in a unit micro-vibration period TB, in which ink in the discharging section D is discharged. In this case, in the unit micro-vibration period TB, the driving signal Com may have a waveform such as, for example, the waveform PP1 to discharge the ink in the discharging section D, instead of the waveform PB.

Second Variation

Although, in the embodiment and first variation described above, the inspecting unit 6 is disposed as a circuit different from the control unit 2, the present disclosure is not limited to this aspect. Part or the whole of the inspecting unit 6 may be implemented as a functional block that is achieved when the CPU in the control unit 2, for example, operates according to a control program.

Third Variation

Although, in the embodiment and first and second variations described above, the ink jet printer 1 is provided so that one or a plurality of head units 3 and one or a plurality of inspection units 6 have a one-to-one correspondence, the present disclosure is not limited to this aspect. In the ink jet printer 1, a single inspecting unit 6 may be provided for a plurality of head units 3 or a plurality of inspection units 6 may be provided for a single head unit 3.

Fourth Variation

Although, in the embodiment and first to third variations described above, a case in which the ink jet printer 1 is a serial printer has been exemplified, the present disclosure is not limited to this aspect. The ink jet printer 1 may be a so-called line printer in which a plurality of nozzles N are provided in the head unit 3 so as to extend beyond the width of recording paper P.

What is claimed is:

1. A head unit comprising:

a first line through which a driving signal is supplied;

a first discharging section that has a first piezoelectric element having a pair of electrodes including a first electrode, the first discharging section discharging a liquid according to displacement of the first piezoelectric element, the displacement being caused when the driving signal is supplied to the first electrode;

a detection circuit that detects a potential of a second line;

a first switch that makes a switchover as to whether to electrically couple the first electrode and the first line together;

a second switch that makes a switchover as to whether to electrically couple the first electrode and the second line together;

a third switch that makes a switchover as to whether to electrically couple the first line and the second line together; and a first resistor provided in series with the third switch between the first line and the second line, wherein the first switch is turned on in a first period, is turned off in a second period following termination of the first period, and is turned off in a third period following termination of the second period, the second switch is turned off in the first period and the second period and is turned on in the third period, the third switch is turned off in the first period and the second period and is turned on in the third period, a potential of the driving signal is set to a first potential in first period, changes from the first potential to a second potential in the second period, and is maintained at the second potential in the third period, and the detection circuit detects the potential of the second line in the third period.

2. The head unit according to claim 1, wherein:

the first switch is turned on in a fourth period following termination of the third period;

the second switch is turned off in the fourth period;

the third switch is turned off in the fourth period; and the potential of the driving signal is maintained at the second potential in the fourth period.

3. The head unit according to claim 2, further comprising:

a second discharging section that has a second piezoelectric element having a pair of electrodes including a second electrode, the second discharging section discharging a liquid according to displacement of the second piezoelectric element, the displacement being caused when the driving signal is supplied to the second electrode;

a fourth switch that makes a switchover as to whether to electrically couple the second electrode and the first line together; and a fifth switch that makes a switchover as to whether to electrically couple the second electrode and the second line together; wherein the fourth switch is turned on in the first period and is turned off in the second period, the third period, and the fourth period, and the fifth switch is turned off in the first period, the second period, the third period, and the fourth period.

4. The head unit according to claim 3, wherein:

the first switch is turned on in a fifth period following termination of the fourth period;

the second switch is turned off in the fifth period;

the third switch is turned on in the fifth period;

the fourth switch is turned off in the fifth period;

the fifth switch is turned on in the fifth period; and the potential of the driving signal is maintained at the second potential in the fifth period.

5. A liquid discharging apparatus comprising:

a creating unit that creates a driving signal;

a first line through which the driving signal is supplied;

a first discharging section that has a first piezoelectric element having a pair of electrodes including a first electrode, the first discharging section discharging a liquid according to displacement of the first piezoelectric element, the displacement being caused when the driving signal is supplied to the first electrode;

a detection circuit that detects a potential of a second line;

an inspecting section that inspects a discharging state of the liquid in the first discharging section according to a result of detection by the detection circuit;

a first switch that makes a switchover as to whether to electrically couple the first electrode and first line together;

a second switch that makes a switchover as to whether to electrically couple the first electrode and the second line together;

a third switch that makes a switchover as to whether to electrically couple the first line and the second line together; and a first resistor provided in series with the third switch between the first line and the second line, wherein the first switch is turned on in a first period, is turned off in a second period following termination of the first period, and is turned off in a third period following termination of the second period, the second switch is turned off in the first period and the second period and is turned on in the third period, the third switch is turned off in the first period and the second period and is turned on in the third period, a potential of the driving signal is set to a first potential in first period, changes from the first potential to a second potential in the second period, and is maintained at the second potential in the third period, and the detection circuit detects the potential of the second line in the third period.

* * * * *